United States Patent [19]

Takamatsu et al.

[11] Patent Number: 4,768,055

[45] Date of Patent: Aug. 30, 1988

[54] IMAGE FORMING MACHINE HAVING A TONER RECYCLING UNIT

[75] Inventors: Junichi Takamatsu, Osaka; Kazunori Akiyama, Suita, both of Japan

[73] Assignee: Mita Industrial Co., Ltd., Japan

[21] Appl. No.: 58,955

[22] Filed: Jun. 5, 1987

[30] Foreign Application Priority Data

| | | | |
|---|---|---|---|
| Jun. 17, 1986 | [JP] | Japan | 61-139272 |
| Jun. 30, 1986 | [JP] | Japan | 61-151660 |
| Jul. 9, 1986 | [JP] | Japan | 61-106092[U] |
| Sep. 16, 1986 | [JP] | Japan | 61-215938 |

[51] Int. Cl.[4] ..... G03G 15/00; G03G 21/00

[52] U.S. Cl. ..... 355/3 R; 355/3 DD; 355/15

[58] Field of Search ..... 355/3 DD, 14 D, 15, 355/4, 3 R; 222/DIG. 1

[56] References Cited

U.S. PATENT DOCUMENTS

| | | | |
|---|---|---|---|
| 3,752,576 | 8/1973 | Gerbasi | 355/15 |
| 4,142,655 | 3/1979 | Fantuzzo | 222/DIG. 1 |
| 4,609,276 | 9/1986 | Mitzutani | 355/3 DR |

FOREIGN PATENT DOCUMENTS

| | | | |
|---|---|---|---|
| 60-41079 | 3/1985 | Japan . | |
| 60-156081 | 8/1985 | Japan | 355/15 |
| 60-229043 | 11/1985 | Japan | 355/4 |
| 61-114277 | 5/1986 | Japan . | |

*Primary Examiner*—Arthur T. Grimley
*Assistant Examiner*—J. Pendegrass
*Attorney, Agent, or Firm*—Beveridge, DeGrandi & Weilacher

[57] ABSTRACT

An image forming machine provided with an image bearing member having a photosensitive material on its surface, a developing device for developing a latent electrostatic image formed on the surface of the photosensitive material, a cleaning device for removing toner remaining on the surface of the photosensitive material, and toner feed means for feeding the toner recovered in the cleaning device to the developing device. According to one aspect, the machine is constructed such that the color of toner used in the developing device can be easily determined. According to a second aspect, the image bearing member, the developing device and the cleaning device are mounted on a detachable unit frame, and the unit frame is adapted to be mounted and detached by means of a simple structure. According to a third aspect, the machine is constructed such that the toner recovered in the cleaning device is mixed in a predetermined amount with fresh toner and then fed to a developing chamber in the developing device. According to a fourth aspect, the machine is constructed such that fresh toner is sealed in a toner recovery chamber in the cleaning device during machine production. According to a fifth aspect, the machine is constructed such that a toner cartridge is loaded into the toner recovery chamber of the cleaning device.

32 Claims, 17 Drawing Sheets

IMAGE FORMING MACHINE HAVING A TONER RECYCLING UNIT

FIELD OF THE INVENTION

This invention relates to various improvements in an image forming machine.

DESCRIPTION OF THE PRIOR ART

As is well known to those skilled in the art, image forming machines such as electrostatic copying machines or electrostatic printing machines of the type adapted to form a latent electrostatic image on an electrostatographic material and then develop the latent electrostatic image to a toner image have gained widespread commercial acceptance.

There is an electrostatic copying machine as one example of such an image forming machine which can perform not only ordinary copying using black toner but also monocolor copying using colored toner such as red or blue toner. Such a conventional electrostatic copying machine cannot easily recognize the color of the toner in use, and it is judged from the image obtained by performing a copying operation. Hence, the copying operation is frequently performed wastefully.

There is also a type of electrostatic copying machine which is provided with a process unit to be detachably mounted on a supporting structure in a main copying system of the machine. In such a conventional electrostatic copying machine, a gripping member exclusively used for mounting and detaching the process unit on and from the supporring structure is provided on a unit frame. Hence, this type of electrostatic copying machine has the defect that the provision of the gripping member makes the structure of the process unit complex.

There is also a type of electrostatic copying machine which is constructed such that the toner removed and recovered from the surface of the electrostatographic material by the action of a cleaning device is re-supplied to the developing device. In such a conventional electrostatic copying machine having the toner re-supplying function, the recovered toner (spent toner) is re-supplied to a toner holding chamber in the developing device which holds new toner (unused toner). This construction, therefore, gives rise to the following problem. Specifically, after the new toner has been used the recovered toner resupplied to the toner holding chamber is fed to the developing chamber. As a result the proportion of the re-supplied toner in the developing chamber abruptly increases, and this leads to a drastically degraded image quality.

In recent years, the manufacturers have tended to supply electrostatic copying machines in such a state that toner is loaded beforehand in the toner holding chamber during machine production instead of letting the users load it in the toner holding chamber of the developing device in installed copying machines before actually starting to operate the machines. This tendency is greater with such a type of electrostatic copying machine that an image bearing member having a photosensitive material, a developing device and a cleaning device are mounted on a common unit frame to constitute a replaceable process unit, and the process unit is mounted detachably on the supporting structure of the main copying system of the machine. However, such a type of electrostatic copying machine requires a space for exclusive use in loading new toner in advance, namely a toner holding chamber. This tends to increase the size of the developing device, and the tendency increases as the amount of the toner to be loaded increases.

There is also a type of electrostatic copying machine in which a toner cartridge containing new toner is loaded into the developing device. This machine is generally of such a structure that the toner cartridge is loaded into the toner holding chamber of the developing device. Hence, the developing device, and in turn the entire machine, tend to increase in size.

SUMMARY OF THE INVENTION

The invention provides an image forming machine with a toner recycling device. The image forming machine comprises a housing and a process unit detachably mounted on a supporting structure within the housing. The process unit includes a toner holding chamber, a developing device, a toner removing device, a toner recovery chamber, and a toner feed device. The developing device applies toner from the toner holding chamber onto a photosensitive material in order to develop an image formed thereon. The toner removing device removes residual toner remaining on the photosensitive material. The removed toner is recovered in the toner recovery chamber. The toner feed device includes a transparent hollow cylindrical member connected between the toner recovery chamber and the toner holding chamber, and a toner transfer device disposed within the hollow cylindrical member. The toner feed device feeds the toner in the toner recovery chamber back to the toner holding chamber for re-use in the developing device.

It is a first object of this invention to provide an image forming machine which permits easy recognition of the color of toner in use.

A second object of this invention is to provide an image forming machine in which a process unit to be mounted detachably on a supporting structure in its main body can be built in a relatively simple structure.

A third object of this invention is to provide an image forming machine in which toner recovered in a cleaning device is effectively re-supplied to a developing device, whereby stable images can be obtained over a relatively long period of time.

A fourth object of this invention is to provide an image forming machine which can be effectively reduced in size by effectively utilizing a space which is left wasteful until it is actually used.

A fifth object of this invention is to provide an image forming machine which can be reduced in size by effectively utilizing a space existing in a cleaning device.

Other objects of the invention along with its features and advantages will become apparent from the following description.

DETAILED DESCRIPTION OF PREFERRED EMBODIMENTS

The invention will be described in detail with reference to the accompanying drawings. The following description is directed specifically to the electrostatic copying machine as one example of the image forming machine, but is also applicable to other types of the image forming machine such as an electrostatic printer.

Outline of First Embodiment of the Electrostatic Copying Machine

First, with reference to FIGS. 1 to 8, a first embodiment of the electrostatic copying machine as one example of the image forming machine of the invention will be described.

Figure 1:
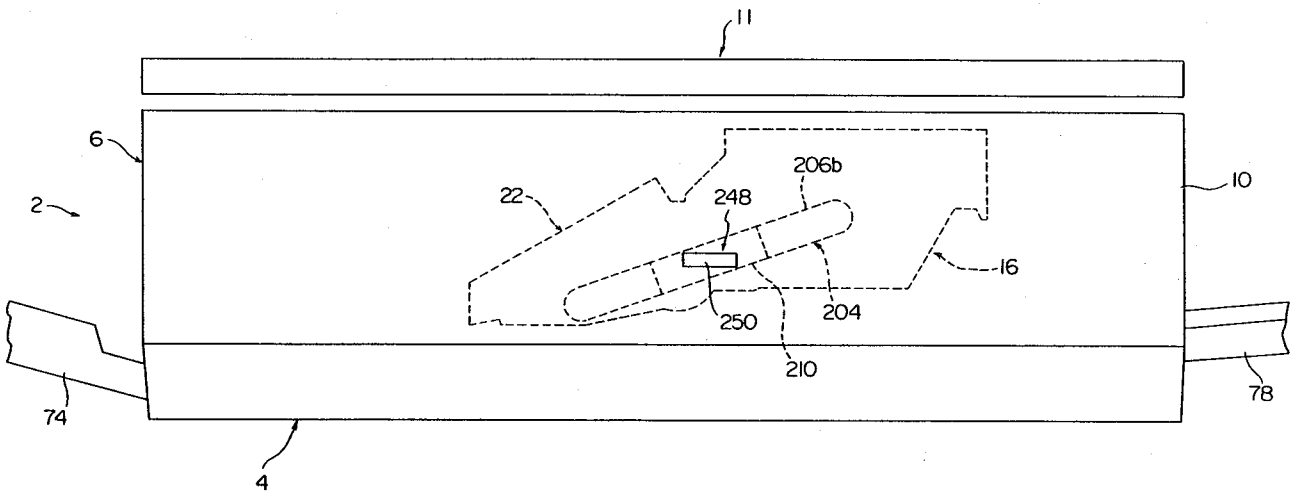
FIG. 1 is a front elevation of a first embodiment of an electrostatic copying machine as one example of the image forming machine constructed in accordance with this invention.
Figure 2:
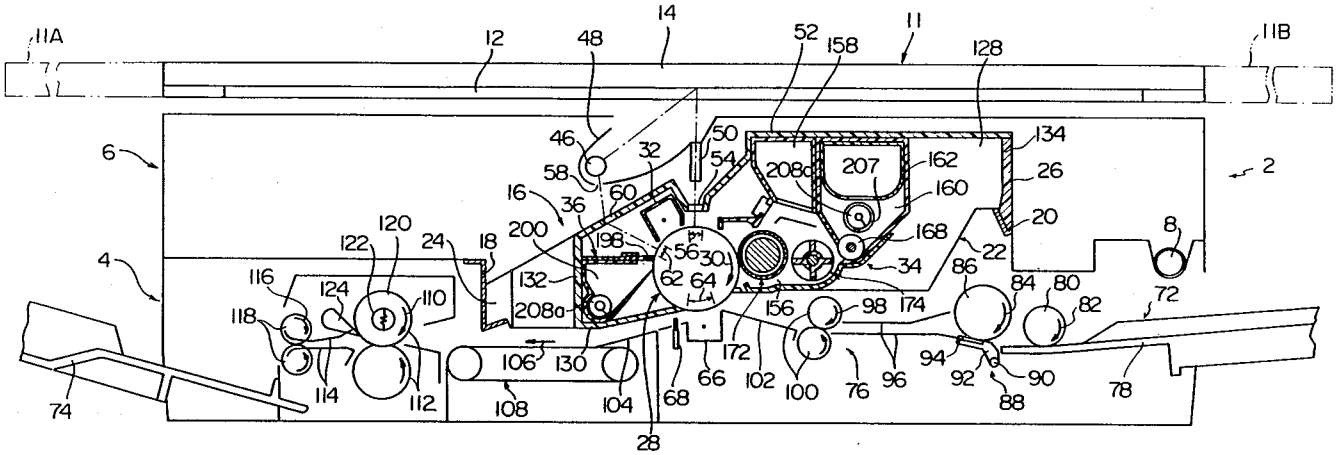
FIG. 2 is a sectional view showing the electrostatic copying machine of FIG. 1 in a simplified form.

With reference to FIGS. 1 to 4, mainly to FIG. 2, the illustrated electrostatic copying machine has a nearly parallelepipedal housing shown generally at 2. The housing 2 in the illustrated embodiment is defined by a supporting structure comprised of a lower supporting frame 4 and an upper supporting frame 6. The lower part of the right end portion of the upper supporting frame 6 is pivotably linked to the lower supporting frame 4 via a shaft 8. The upper supporting frame 6 can pivot between a closed position shown in FIGS. 1 and 2 and an open position shown in FIGS. 3 and 4. At the front surface of the housing 2, a front cover 10 is mounted on the upper supporting frame 6 for free pivoting between a closed position (the position shown in FIG. 1) and an open position (the position shown in FIG. 3) around its lower end portion as a center.

Document placing means 11 capable of reciprocation in the left-right direction is mounted on the upper surface of the housing 2, i.e. the upper surface of the upper supporting frame 6. The document placing means 11 includes a transparent plate 12 on which to place a document to be copied, and a document cover 14 which can be opened or closed and covers the transparent plate 12 and a document to be placed on it.

A process unit shown generally at 16 is detachably mounted on the upper supporting frame 6 and positioned nearly centrally in the housing 2. A pair of supporting rails 18 and 20 spaced from each other in the left-right direction and extending in a direction perpendicular to the sheet surface are fixed to the upper supporting frame 6. On the other hand, the process unit 16 has a unit frame 22, and portions 24 and 26 to be supported extending in a direction perpendicular to the sheet surface are formed on the left and right side portions of the unit frame 22. The process unit 16 is mounted on and detached from the upper supporting frame 6 by bringing the portions 24 and 26 of the unit frame 22 into engagement with the supporting rails 18 and 20 and sliding the unit frame 22 in a direction perpendicular to the sheet surface. A rotating drum 28 constituting an image bearing member is rotatably mounted on the nearly central part of the unit frame 22. A suitable electrostatographic material is disposed on the peripheral surface of the rotating drum 28. Furthermore, around the rotating drum 28 to be rotated in the direction shown by an arrow 30, a charging corona discharge device 32, a developing device shown generally at 34, and a cleaning device shown generally at 36 in this sequence as viewed in the rotating direction of the rotating drum 28 are mounted on the unit frame 22. The developing device 34 and the cleaning device 36 will be more specifically described hereinafter.

An illuminating lamp 46, a reflecting plate 48 and an optical system 50, positioned above the process unit 16, are also mounted on the upper supporting frame 6. The optical system 50 is comprised of many elongate optical units (for example, rod-like lenses sold under the tradename "Selfoc Microlens" by Nippon Sheet Glass Co., Ltd.) extending in the vertical direction. The light from the illuminating lamp 46 illuminates the document placed on the transparent plate 12 as shown by a one-dot chain line. The reflected light from the document passes through the optical system 50 and an exposure opening 54 formed in the upper wall 52 of the unit frame 22 and is projected onto the peripheral surface of the rotating drum 28 in the exposure zone 56. Part of the light from the illuminating lamp 46, as shown by a one-dot chain line, is projected onto the rotating drum 28 in a charge eliminating zone 62 via an opening 58 formed in the under surface of the reflecting plate 48 and an opening 60 formed in the upper wall 52 of the unit frame 22 for passing charge eliminating light.

Nearly centrally of the lower supporting frame 4 are disposed a transfer corona discharge device 66 facing the peripheral surface of the rotating drum 28 in a transfer zone 64 and a peeling charge-eliminating device 68 located adjacent to, and downstream of, the transfer corona discharge device 66.

Furthermore, in the right end portion of the lower supporting frame 4, copying paper feed means shown generally at 72 is disposed, and a copying paper receiving tray 74 is provided in the left end portion of the lower supporting frame 4. A copying paper conveying system shown generally at 76 is disposed between the paper feeding means 72 and the paper receiving tray 74 for conveying paper through the transfer zone 64. The paper feed means 72 comprises a paper receiving stand 78 and a paper delivery roller 80 disposed above the downstream end portion of the paper stand 78. The paper delivery roller 80 is adapted to be selectively elevated or lowered and simultaneously rotated in the direction shown by an arrow 82. The paper feed means 72 further includes a paper feed roller 86 disposed downstream of the paper stand 78 and adapted to be rotated in the direction shown by an arrow 84, and paper separating means 88 disposed below it. The paper separating means 88 has a supporting member 92 pivotably mounted by a pin 90 and a separating member 94 made, for example, of a high friction material such as synthetic rubber and disposed on the upper surface of the supporting member 92. The supporting member 92 is elastically biased clockwise by suitable spring means (not shown). Thus, the separating member 94 is elastically pressed against the paper feed roller 86. In the paper feed means 72 described above, a layer of copying paper sheets of a suitable size is manually inserted and placed on the paper stand 78. Every time the paper delivery roller 80 is lowered and rotated in the direction of arrow 82, one uppermost sheet is delivered and further advanced by the feed roller. The separating member 94 serves to prevent sheets other than the uppermost sheet from being advanced by the paper feed roller 86 when two or more sheets are delivered at a time by the delivery roller 80, and thus to ensure that the copying sheets are fed one by one by the paper conveying system 76. The paper conveyor system 76 comprises a guide plate pair 96, a conveying roll pair 100 to be rotated in the direction shown by an arrow 98, guide plates 102 and 104, a conveyor belt mechanism 108 to be rotated in the direction shown by an arrow 106, a heat fixing roller pair 112 to be rotated in the direction of an arrow 110, a guide plate pair 114 and a discharge roller pair 118 to be rotated in the direction shown by an arrow 116. Suitable heating means 122 is disposed in an upper heating roller 120 in the heat fixing roller pair 112. A separating member 124 is annexed to the upper heating roller 120 to prevent wrapping of the paper.

In the electrostatic copying machine described above, while the rotating drum 28 is rotated in the direction of arrow 30, the charging corona discharge device 32 substantially uniformly charges the photosensitive material on the rotating drum 28 to a specified polarity. Then, in the exposure zone 56, the image of the document on the transparent plate 12 is scanned and exposed onto the photosensitive material whereby a latent electrostatic image corresponding to the image of the document is formed on the photosensitive material. During scanning and exposure, the document placing means 11 is moved rightward for scanning and exposure from a start-of-scan position shown by a two-dot chain line 11A to an end-of-scan position shown by a two-dot chain line 11B. Thereafter, the latent electrostatic image on the photosensitive material is developed to a toner image by the developing device 34. Copying paper fed from the paper feed means 72 by the paper conveying system 76 is brought into intimate contact with the peripheral surface of the rotating drum 28 in the transfer zone 64, and by the action of the transfer corona discharge device 66, the toner image on the photosensitive material is transferred to the copying paper. Subsequently, the copying paper is separated from the rotating drum 28 by the action of the charge eliminating device 68. The separated copying paper is conveyed through the heat fixing roller pair 112, and during this time, the toner image on the paper is heat-fixed, and the paper is discharged onto the paper receiving tray 74. In the meantime, the rotating drum 28 continues to rotate, and the toner remaining on the photosensitive material after the transfer is removed from it by the action of the cleaning device 36. Then, charge-eliminating light is irradiated onto the photosensitive material in the charge eliminating device 62 to erase the residual charge on the photosensitive material.

Process Unit in the Electrostatic Copying Machine in the First Embodiment

Figure 5:
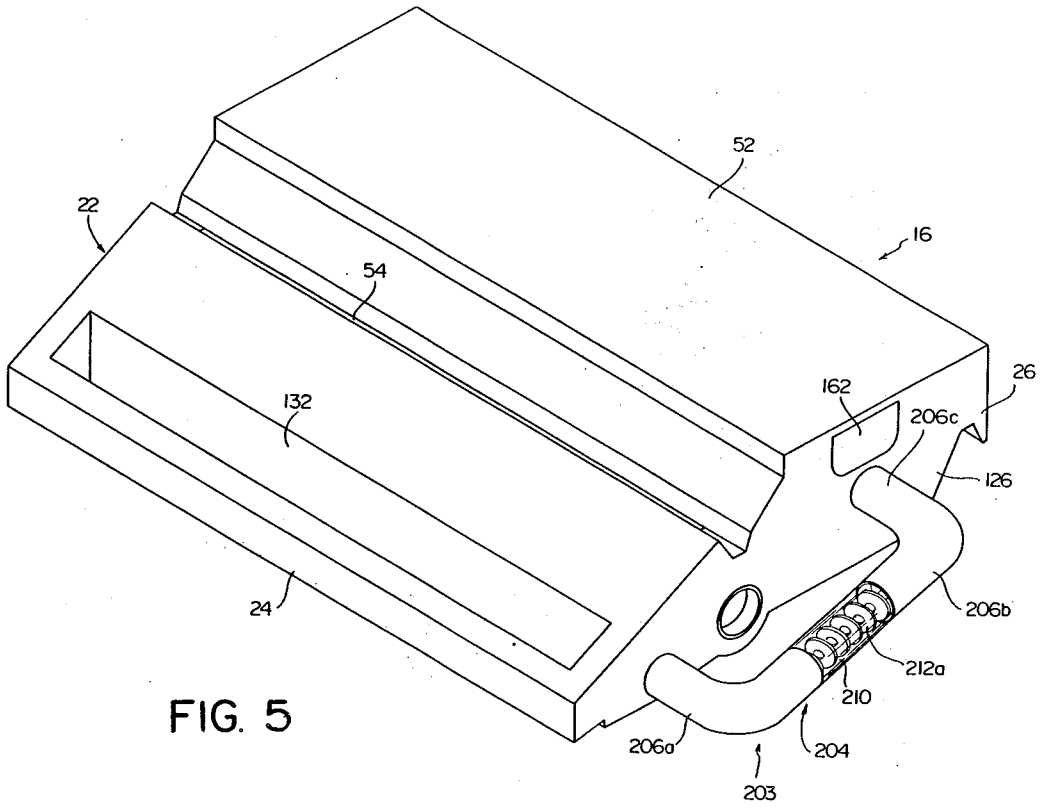
FIG. 5 is a perspective view showing a process unit in the electrostatic copying machine of FIG. 1.
Figure 6:
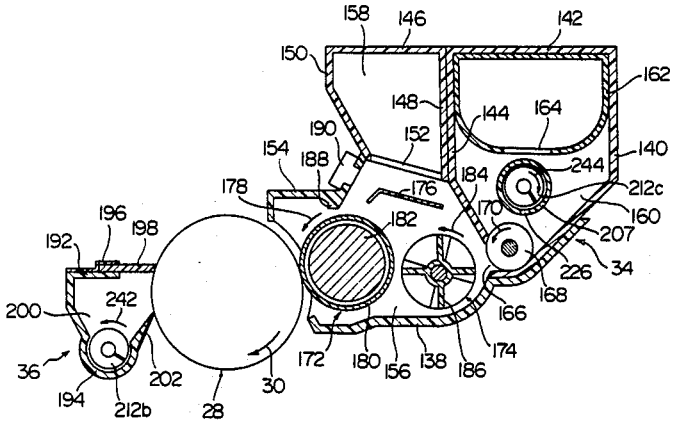
FIG. 6 is a sectional view showing a rotating drum, a developing device and a cleaning device mounted on a unit frame in the process unit of FIG. 5.

With reference mainly to FIGS. 5 and 6 taken in conjunction with FIG. 2, the unit frame 22 of the illustrated process unit 16 has a front wall 126 (FIG. 5) and rear wall 128 (FIG. 2) disposed in spaced-apart relationship in the front-rear direction (the direction perpendicular to the sheet surface in FIGS. 2 and 6, and the direction from right bottom to left top in FIG. 5), and the rotating drum 28, the developing device 34 and the cleaning device 36 are mounted between the front wall 126 and the rear wall 128. A bottom wall 130, a left side wall 132 and a right side wall 134 together with the upper wall 52 mentioned hereinabove are provided between the front wall 126 and the rear wall 128. A transfer opening is formed in the bottom wall 130 to permit copying paper conveyed by the action of the paper conveying system 76 to make contact with the peripheral surface of the rotating drum 28 in the transfer zone 64, and the lower end portion of the right side wall 134 serves as the portion 26 to be supported.

The rotating drum 28 is mounted rotatably between the front wall 126 and the rear wall 128. The rotating drum 28 is designed to be drivingly connected to a driving source (not shown; constituting a driving source of the electrostatic copying machine) disposed in the lower supporting frame 4 when the process unit 16 is mounted detachably on the upper supporting frame 6 and the upper supporting frame 6 is brought to the closed position, and there by to rotate in the direction of arrow 30.

The illustrated developing device 34 has walls 138, 140, 142, 144, 146, 148, 150, 152 and 154 fixed between the front wall 126 and the rear wall 128 of the unit frame 22, and includes three chambers defined by these walls, i.e. a developing chamber 156, a developer holding chamber 158 and a toner holding chamber 160. A toner cartridge 162 is detachably loaded into the toner holding chamber 160. Fresh toner (not shown) is held in the toner cartridge 162, and by loading the toner cartridge 162, the fresh toner can be supplied. A discharge opening 164 of the toner cartridge 162 is sealed by a suitable sealing member (not shown). The toner cartridge 162 is loaded as shown in FIGS. 2 and 6 by inserting the toner cartridge 162 into the toner holding chamber 160 while peeling the sealing member. As a result, the discharge opening 164 is opened and the fresh toner in the cartridge 162 is supplied through the discharge opening 164. The illustrated embodiment is in such a condition that fresh toner can be supplied. When toner supply is not necessary (for example, if the machine is of such a type that when all the toner held in the toner holding chamber 160 is used up, the entire process unit 16 is replaced by a new one), fresh toner may be directly supplied to the toner holding chamber 160 defined by the walls 140, 142 and 144. A toner discharge opening 166 is formed at the bottom of the toner holding chamber 160, and a slender cylindrical toner feed roller 168 is disposed in the toner discharge opening 166. The toner feed roller 168 is rotated in the direction shown by an arrow 170 thereby to cause the toner in the toner holding chamber 160 to be fed into the developing chamber 156 through the toner discharge opening 166.

The developing chamber 156 is opened at its left side facing the rotating drum 28. Applicator means 172, developer agitating means 174 and a guide plate 176 are disposed in the developing chamber 156. The applicator means 172 may be comprised of a cylindrical sleeve 180 to be rotated in the direction shown by an arrow 178 and a stationary permanent magnet 182 disposed within the sleeve 180 and having a plurality of circumferentially spaced magnetic poles. The agitating means 174 has a plurality of helical vanes 186 to be rotated in the direction shown by an arrow 184 and serves to agitate the developer within the developing chamber 156 and feed it to the applicator means 172. Brush cutting means 188 projecting toward the sleeve 180 of the applicator means 172 is formed in the wall 154 defining the upper wall of the left side of the developing chamber 156. The brush cutting means 188 acts on the developer moving while being magnetically held to the surface of the sleeve 180, and removes the excess of the developer. A toner concentration detector 190 positioned above the brush cutting means 188 is provided in the wall 154. The detector 190 which may be a known type has a detecting surface exposed to the inside of the developing chamber 156 and detects the toner concentration of the developer removed from the applicator means 172 by the action of the brush cutting means 188.

The developer holding chamber 158 is disposed on the developing chamber 156. A starting developer (a fresh developer consisting of carrier and toner in a particular mixing ratio) is held in the developer holding chamber 158. When a two-component developer is used, a mixture composed of carrier and toner is held in the developing chamber 156. When a one-component developer is used, toner is held in it, and the developer holding chamber 158 may be omitted.

In starting to use the developing device 34, the starting developer held in the developer holding chamber 158 is supplied to the developing chamber 156. Then, the toner cartridge 162 is loaded in position into the toner holding chamber 160 by inserting it while removing the sealing member (not shown). As a result, the discharge opening 164 of the toner cartridge 162 is opened, and the toner in the toner cartridge 162 is supplied to the toner holding chamber 160 through the discharge opening 164. The toner holding chamber 160 is now ready for feeding the toner. In the illustrated embodiment, the discharge opening 164 extends substantially from one end to the other end of the toner holding chamber 160 in the widthwise direction above the toner feed roller 168. Hence, the fresh toner in the cartridge 162 is supplied substantially uniformly to the toner holding chamber 160 from its one end to the other in the widthwise direction. The above operation enables the developing device 34 to develop the latent electrostatic image. In performing the development, the agitating means 174 is rotated in the direction of arrow 184 in the developing chamber 156 to agitate the developer and charge the toner to a particular polarity. The developer is delivered toward the applicator means 172. The sleeve 180 in the applicator means 172 is rotated in the direction shown by an arrow 178. The developer delivered by the action of the agitating means 174 is held onto the surface of the sleeve 180 by the magnetic attracting force of the magnet 182 within the sleeve 180 and conveyed in the direction shown by an arrow 178 as the sleeve 180 rotates. The excess of the developer held onto the surface of the sleeve 180 is removed by the action of the brush cutting means 188. The removed developer is moved upwardly along the inner surface of the wall 154, then caused to flow down over the guide plate 176 toward the agitating means 174, and again agitated by the agitating means 174. In the meantime, the developer held onto the surface of the sleeve 180 and conveyed in the direction of arrow 178 is brought into contact with the photosensitive material disposed on the surface of the rotating drum 28. The toner in the developer is applied to a latent electrostatic image on the photosensitive material to develop the latent electrostatic image to a toner image. When the toner concentration of the developer decreases as a result of the developing action, the detector 190 produces a signal which in turn causes the toner feed roller 168 to rotate in the direction of arrow 170 and supply the toner in the toner holding chamber 160 to the developing chamber 156.

The illustrated cleaning device 36 has a pair of end walls (not shown) disposed in spaced-apart relationship in the front-rear direction in the inside of the unit frame 22, and walls 192 and 194 extending in the aforesaid front-rear direction are provided between these end walls. An elastic blade 198 is attached to the upper surface of the wall 192 of the cleaning device 36 by a fixing member 198. The elastic blade 198 constitutes toner removing means, and its free end portion is kept in press contact with the peripheral surface of the rotating drum 28 under a predetermined pressure. The cleaning device 36 is provided with a toner recovery chamber 200 defined by the walls 192 and 194. The toner recovery chamber 200 is open at that site which faces the rotating drum 28, and a sealing member 202 is disposed in the opening portion. The sealing member 202 is attached to the outside surface of the wall 194, and its free end is kept in contact with, or in proximity to, the peripheral surface of the rotating drum 28. When the rotating drum 28 is rotated in the direction of arrow 30, the residual toner on the surface of the photosensitive material is removed by the elastic blade 198. The removed toner is guided by the sealing member 202 and the inside surface of the wall 194 and recovered into the toner recovery chamber 200.

The copying machine described above is further constructed such that the toner recovered into the toner recovery chamber 200 is again fed to the toner holding chamber 160. With reference to FIGS. 3, 5, 6 and 8, the process unit 16 further includes toner feed means 203 for conducting the toner recovered and received in the toner recovery chamber 200 to the toner holding chamber 156. The illustrated toner feed means 203 comprises a hollow cylindrical member 204 communicating with the toner recovery chamber 202 and the toner holding chamber 156, and toner transfer means for transferring the toner through the hollow cylindrical member 204. In the illustrated embodiment, the toner transfer means is constructed of a slender helical member 208.

Figure 8:
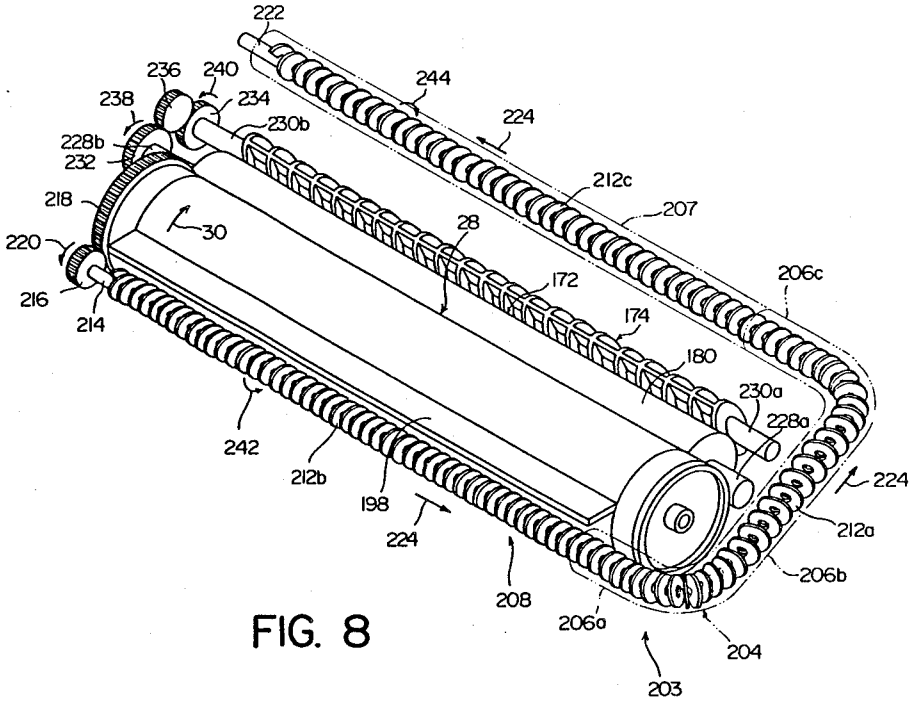
FIG. 8 is a perspective view showing toner feed means and elements related thereto in the process unit shown in FIG. 5.

An opening is formed at a required site of one end wall (the end wall positioned at a front site in the front-rear direction) of the cleaning device 36, and an opening corresponding to the above opening is also formed at a required site of the front wall 126 of the unit frame 22. Also, an opening is formed at a required site of the front wall 126 of the unit frame 22 corresponding to the toner holding chamber 160 of the developing device 34. One end portion **206*a* of the hollow cylindrical member 204 is connected to the opening formed in one end wall of the cleaning device 36 through the above one opening formed in the front wall 126 of the unit frame 22. Its intermediate portion 206*b* extends laterally from left to right ahead of the front wall 126, and its other end portion 206*c* is connected to the other opening formed in the front wall 126 of the unit frame 22. In the illustrated embodiment, the toner cartridge 162 is detachably loaded into the upper space of the toner holding chamber 16 as shown in FIGS. 6 and 8, and a hollow cylindrical guide member 207 is disposed below the discharge opening 164 of the toner cartridge 162. The hollow guide member 207 extends from one end to the other of the toner holding chamber 160 in the widthwise direction. Namely, it extends from the inside surface of the front wall 126 of the unit frame 22 to the inside surface of the rear wall 128, and the other end portion 206*c* of the hollow cylindrical member 204 is caused to communicate with one end of the hollow guide member 207. Instead of providing the hollow guide member 207 separately, it is possible to extend the other end portion 206*c* of the hollow cylindrical memer 204 from the front wall 126 to the rear wall 128 of the unit frame 22 within the toner holding chamber 160 and utilize the other end portion 206*c*** as a hollow guide member.

It is critical that at least part of the hollow cylindrical member 204 should be transparent or semi-transparent. In the illustrated embodiment, a short cylindrical member 210 made from a transparent or semi-transparent synthetic resin is connected to part of the intermediate portion **206*b* (a part to be gripped as described hereinafter) of the hollow cylindrical member 204. An intermediate portion 212*a* of the helical member 208 is situated within the intermediate portion 206*b* of the hollow cylindrical member 204, and its one end portion 212*b* is positioned within the toner recovery chamber 200 of the cleaning device 36 via the one end portion 206*a* of the hollow cylindrical member 204. Its other end portion 212*c* is positioned within the hollow guide member 207 via the other end portion 206*c* of the hollow cylindrical member 204 (FIG. 8). In the toner recovery chamber 200, one end portion 212*b* of the helical member 208 extends in the widthwise direction, namely in the aforesaid front-rear direction, in its bottom portion, and a shaft portion 214 provided at its one end is rotatably mounted on the other end wall (the end wall positioned rearwardly in the front-rear direction) of the cleaning device 36. The shaft portion 214 projects rearwardly through the aforesaid other end wall, and a gear 216 is mounted on its projecting end. The gear 216 meshes with a large gear 218 provided in the rear end portion of the rotating drum 28. Rotation of the rotating drum 28 in the direction of arrow 30 causes the gear 216 to rotate in the direction shown by an arrow 220 via the large gear 218. Within the hollow guide member 207, the other end portion 212*c* of the helical member 208 extends axially of the hollow guide member 207, namely in the aforesaid front-rear direction, and a shaft portion 222 provided at its other end is rotatably mounted on the rear wall 128 of the unit frame 22. As can be seen from FIG. 8, the helical member 208 has the shaft portions 214 and 222 at its both ends, but the remainder has no shaft portion and is hollow. Furthermore, the helical member 208 is helically wound such that when the gear 216 is rotated in the direction of arrow 220, it transfers the toner in the direction shown by an arrow 224 (FIG. 8**).

As shown in FIG. 8, in the applicator means 172, shaft portions **228*a* and 228*b* provided at its opposite end portions are rotatably mounted on the front wall 126 (FIG. 5) and the rear wall 128 (FIG. 2) of the unit frame 22. In the agitating means 174, shaft portions 230*a* and 230*b* provided at its opposite end portions are rotatably mounted on the front wall 126 and the rear wall 128. A shaft portion 228*b* of the sleeve 180 projects rearwardly through the rear wall 128, and a gear 232 is mounted on this projecting end. The shaft portion 230*b* of the agitating means 174 projects rearwardly through the rear wall 128, and a gear 234 is mounted on its projecting end. The gears 232 and 234 are drivingly connected to each other via a small gear 236. Hence, when the gear 232 is turned in the direction shown by an arrow 238 by the aforesaid driving source (not shown) of the copying machine (whereby the sleeve 180 is rotated in the direction shown by arrow 178), the gear 234 is rotated in the direction shown by an arrow 240 via the gear 236 (whereby the agitating means 174 is rotated in the direction shown by arrow 184**).

When the rotating drum 28 is rotated in the direction of arrow 30 in the copying machine provided with the feed means 203 described above, the helical member 208 is rotated properly via the large gear 218 and the gear 216. Specifically, its one end portion **212*b* positioned within the toner recovery chamber 200 is rotated in the direction shown by an arrow 242 (FIGS. 6 and 8) to transfer the toner in the direction of arrow 224 from the rear end of the toner recovery chamber 200 toward its front end. The toner so transferred is fed to the toner holding chamber 160 via the hollow cylindrical member 204. In the hollow guide member 207, the other end portion 212*c* of the helical member 208 is rotated in the direction shown by an arrow 244 (FIGS. 6 and 8), and the toner fed to the toner holding chamber 160 as above is transferred from one end of the hollow guide member 207 toward its other end in the direction of arrow 224 by the action of the other end portion 212*c* rotating in the direction of arrow 244. While being transferred within the hollow guide member 207, the toner from the toner recovery chamber 200 is fed into the toner holding chamber 160 through a plurality of openings 226 (FIGS. 6 and 7**).

Figure 7:
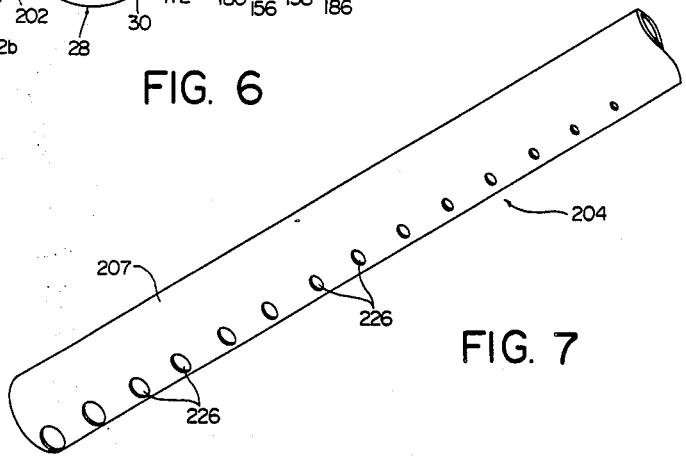
FIG. 7 is a partial perspective view showing on an enlarged scale part of a hollow guide member in the process unit shown in FIG. 5.

Preferably, the plurality of openings 226 are formed in spaced-apart relationship axially of the hollow guide member 207 as shown in FIG. 7. Preferably, the openings 226 are progressively smaller one way in the widthwise direction of the toner holding chamber 156 (namely, frontwardly in the frontrear direction), and progressively larger the other way in the widthwise direction of the toner holding chamber 156 (i.a., rearwardly in the front-rear direction).

Since the openings 226 are progressively smaller toward the front end side of the hollow guide member 207, the proportion of the toner to be supplied is small in spite of the relatively large amount of the toner in the front end portion. On the other hand, since the openings 226 are progressively larger toward the rear end side, the proportion of the toner supplied is large in spite of the relatively small amount of the toner in the rear end portion. Consequently the toner from the recovery chamber 200 can be supplied substantially uniformly in the widthwise direction of the toner holding chamber 160.

The copying machine described above has the following noteworthy features. With reference mainly to FIGS. 6 and 8, a first holding chamber is defined by the detachably loaded toner cartridge 162 in the upper portion of the toner holding chamber 160. A mixing chamber is defined in the lower portion of the toner holding chamber 160, and a second holding chamber is defined by the hollow guide member 207 in the upper portion of the mixing chamber. Accordingly, fresh toner in the toner cartridge 162 is fed into the mixing chamber through the discharge opening 164. The toner recovered from the cleaning device 36 is fed to the lower portion of the mixing chamber through the openings 226 formed in the hollow guide member 207. The toner from the toner cartridge 162 and the toner from the hollow guide member 207 are mixed in the lower portion of the mixing chamber in the toner holding chamber 160, or in other words, near the toner feed roller 168. The mixed toner is fed to the developing chamber 156 through the discharge opening 166. Hence, the toner for reuse from the cleaning device 36 is mixed in a substantially constant proportion with the fresh unused toner from the toner cartridge 162, and the mixed toner is again fed to the developing chamber 156. Accordingly, stable images can be obtained over a relatively long period of time while inhibiting marked degradation of image quality.

In relation to the fact that the hollow cylindrical member 204 is partly transparent or semi-transparent, the illustrated copying machine further has a window portion 248 at a required site of the front cover member 10, as shown in FIG. 1. In the illustrated embodiment, the window portion 248 is constructed by covering the opening formed in the front cover member 10 with a member 250 formed of a transparent or semitransparent material. Instead of this structure, an opening may simply be formed in the front cover member 10. In this case, it is preferred that the front surface of the front cover member 10 and the intermediate portion 212*a* acting as a gripping portion of the hollow cylindrical member 204 should define nearly the same plane. Because of the above structure, part of the toner transferred from the toner recovery chamber 200 to the toner holding chamber 160 via the hollow cylindrical member 204 can be viewed through the member 210 of the hollow cylindrical member 204. Furthermore, the member 210 can be viewd through a member 250 attached to the front cover member 10. When, therefore, part of the hollow cylindrical member 204 is rendered transparent or semi-transparent the color of the toner in the developing chamber 156 and being in use can be easily determined without performing the copying cycle by removing the front cover member 10. Furthermore, when the window portion 248 is provided in the front cover member 10 at a site corresponding to the transparent or semi-transparent portion of the hollow cylindrical member 204, the color of the toner in use can be easily determined from outside without removing the front cover member 10.

Figure 3:
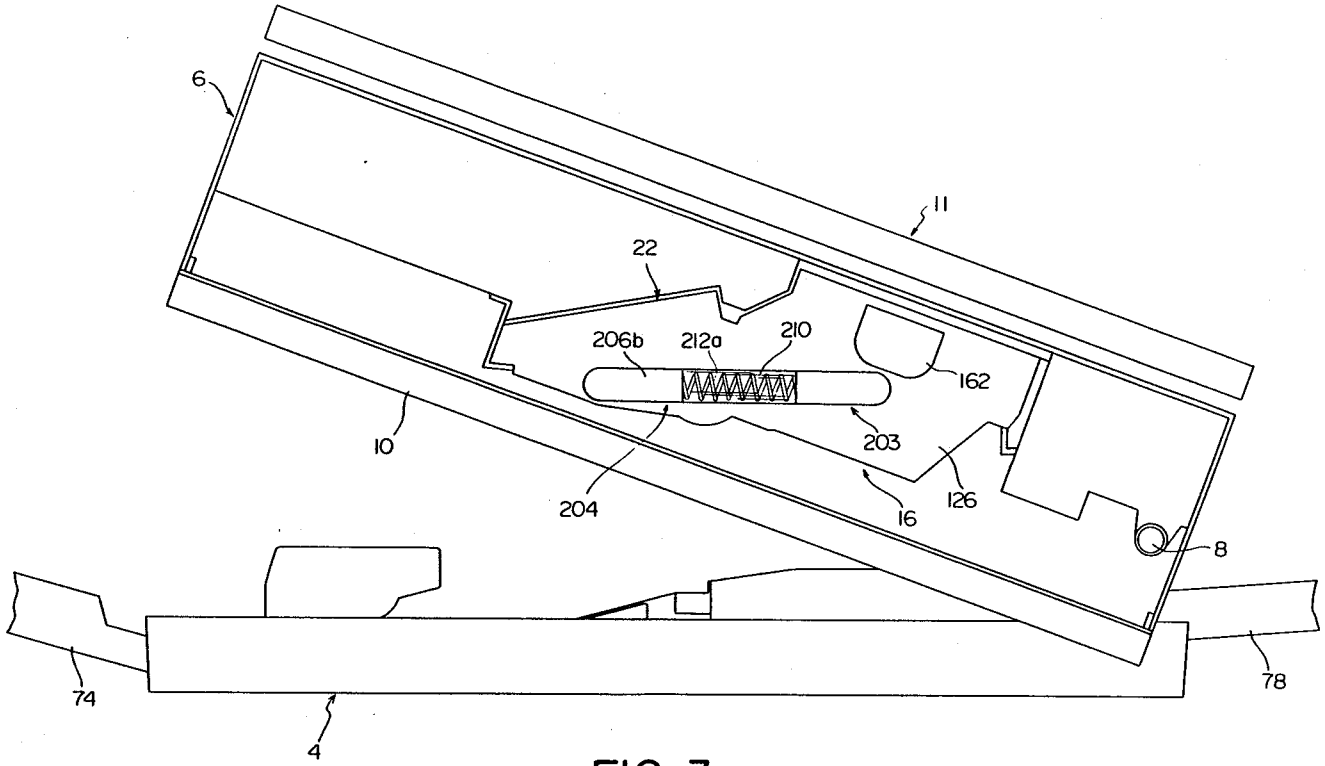
FIG. 3 is a front elevation showing the state in which an upper supporting frame in the electrostatic copying machine of FIG. 1 is held at an open position and a front cover member in it is held in an open state.
Figure 4:
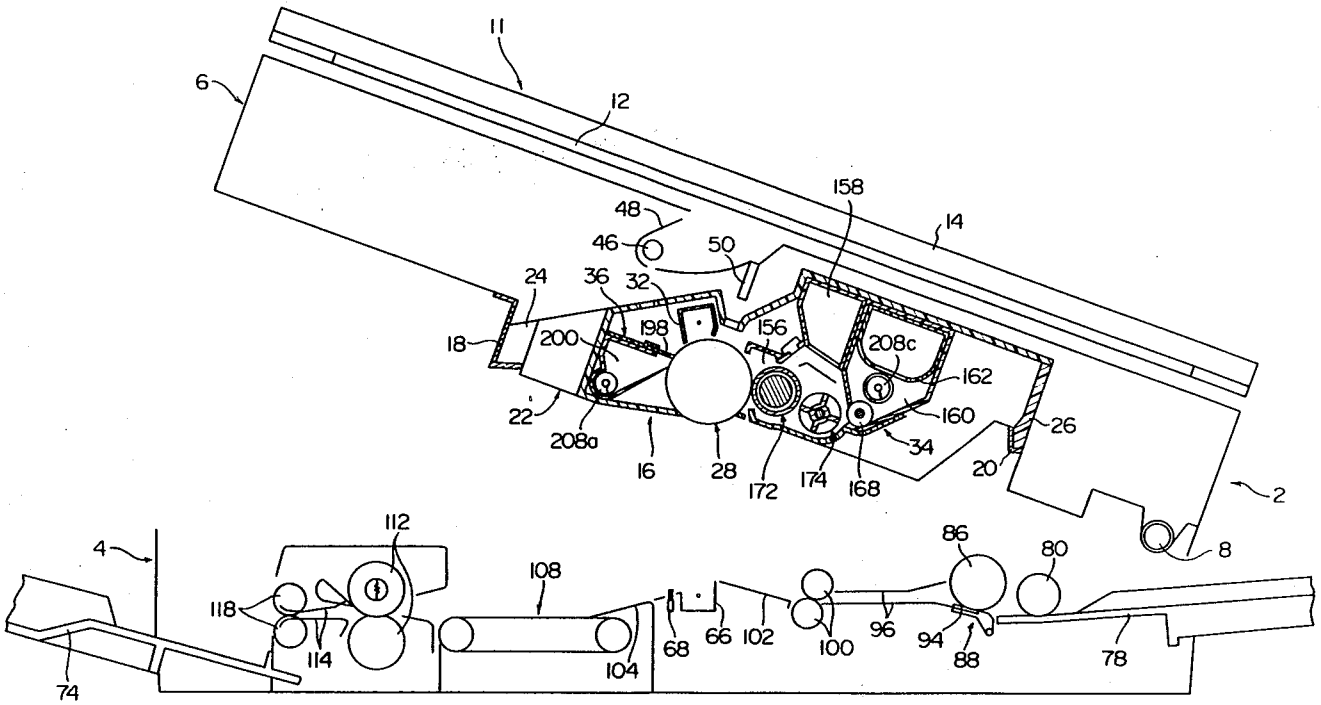
FIG. 4 is a sectional view showing the state of FIG. 3 in a simplified form.

Mounting and Detaching of the Process Unit in the Electrostatic Copying Machine in the First Embodiment With reference mainly to FIGS. 1 to 4, when the process unit 16 is to be mounted on the upper supporting frame 6 in the housing 2, the upper supporing frame 6 is held at the open position as shown in FIGS. 3 and 4 by properly pivoting it.

Then, the front cover attached to the upper supporting frame 6 is pivoted forwardly with its lower end portion as a fulcrum to open the front surface of the upper supporting frame 6. It is also possible to hold the front cover member 10 in the open state and then bring the upper supporting frame 6 to the open position.

Thereafter, the portions 24 and 26 provided in the unit frame 22 are engaged with the supporting rails 18 and 20, and the unit frame 22 is mounted in position by moving it rearwardly in the front-rear direction (the direction perpendicular to the sheet surface in FIGS. 1 to 4). When the portions 24 and 26 to be supported are engaged with the supporting rails 18 and 20 while the upper supporting frame 6 is at the open position, the intermediate portion 206*b*, located ahead of the front wall 126 of the unit frame 22, of the hollow cylindrical member 204 is positioned substantially horizontally. Therefore, in moving the unit frame 22 rearwardly, the intermediate portion 206*b* of the hollow cylindrical member 204 can be easily grasped. Furthermore, as a result of this engagement, the supporting rail portions 18 and 20 support the portions 24 and 26 in a substantially perpendicular direction. Hence, by grasping the intermediate portion 206*b* of the hollow cylindrical member 204 serving as a gripping portion, the unit frame 22 can be moved easily and smoothly.

After the mounting operation, the front cover member 10 is held in the closed state, and the upper supporting frame 6 is pivoted to the closed position shown in FIGS. 1 and 2 (alternatively, the upper supporting frame 6 may first be held at the closed position, and then the front cover member 10 may be held in the closed state). As a result, various constituent elements (such as the illuminating lamp 46) mounted on the upper supporting member 6, various constituent elements (the rotating drum 28, the developing device 34, the cleaning device 36, etc.) mounted on the unit frame 22, and various constituent elements mounted on the lower supporting frame 4 (such as the paper conveying system 76) are maintained in the positional relation shown in FIG. 2, and the copying machine is ready for performing a copying operation.

On the other hand, when paper which has jammed up in the paper conveying system 76 is to be removed or the process unit 16 is to be removed from the upper supporting frame 6 in the housing 2, the upper supporting frame 6 is pivoted as above to the open position. It will be easily understood from FIG. 4 that as a result, a greater part of the paper conveying passage defined by the paper conveying system 76 is opened, and the jamming paper can be easily removed from the paper conveying system 76.

To detach the process unit 16 from the upper supporting frame 6, the upper supporting frame 6 is held at the open position and then the front cover member 10 is pivoted and held in the open state shown in FIG. 3. The unit frame 22 is then moved forwardly in the front-rear direction and detached from the upper supporting frame 6. Since the intermediate portion **206*b* of the hollow cylindrical member 204 is positioned substantially horizontally and the supporting portions 18 and 20 support the portions 24 and 26 in a substantially perpendicular direction, the intermediate portion 206*b* can be easily grasped and smoothy moved forwardly, and by so doing, the unit frame 22** can be easily detached in the required manner.

Process Unit in the Electrostatic Copying Machine in Second Embodiment

Now, with reference to FIGS. 9 and 10, the process unit in a second embodiment of the electrostatic copying machine as one example of the image forming machine in accordance with this invention will be described. In the process unit, improvement is made in the toner holding chamber of the developing device in the first embodiment shown in FIGS. 1 to 8.

Figure 9:
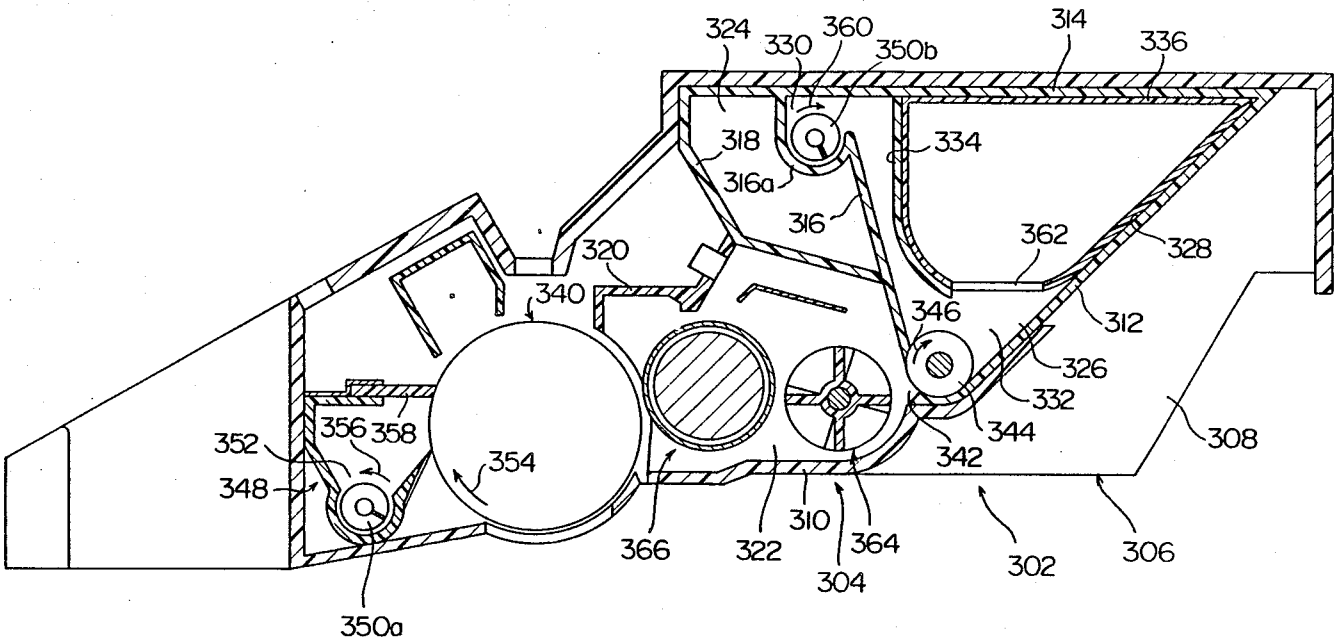
FIG. 9 is a sectional view showing a process unit in a second embodiment of electrostatic copying machine as one example of the image forming machine constructed in accordance with this invention.
Figure 10:
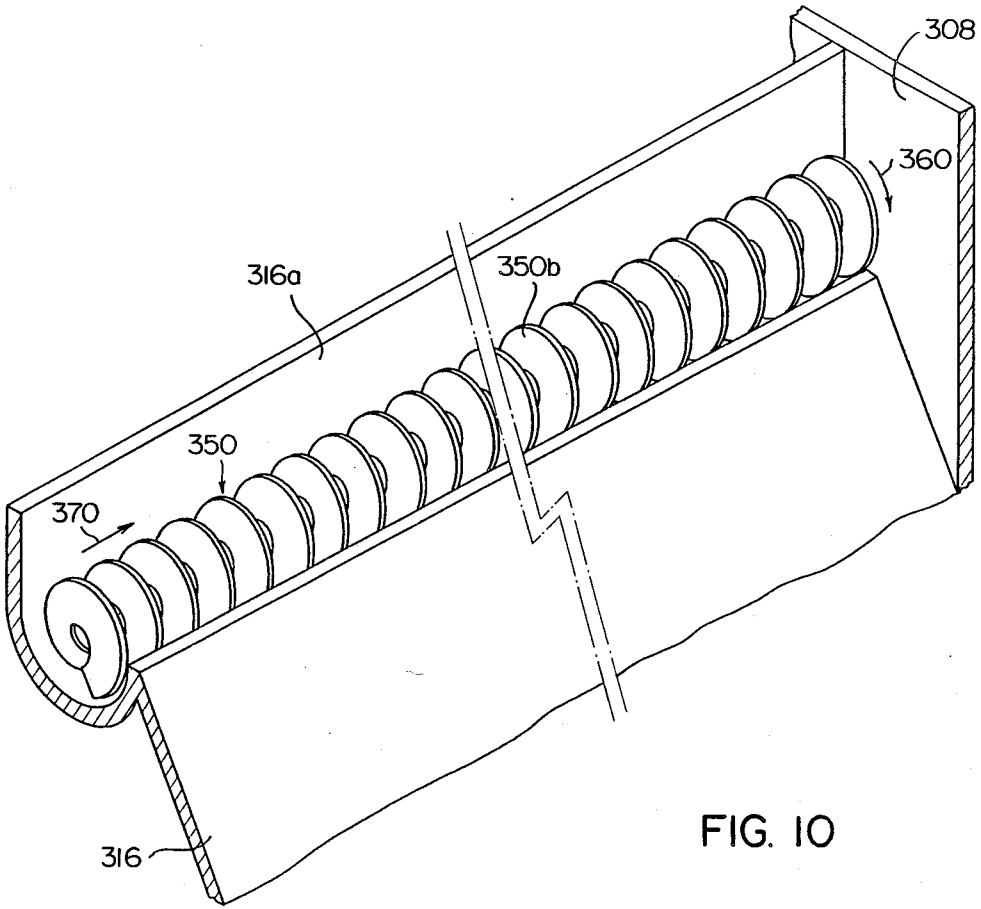
FIG. 10 is a perspective view showing a second holding chamber and its vicinity in the process unit shown in FIG. 9.

With reference mainly to FIG. 9, a developing device 304 in the illustrated process unit 302 has three chambers, i.e. a developing chamber 322, a developer holding chamber 324 and a toner holding chamber 326, defined by walls 310, 312, 314, 316, 318 and 320 fixed between a front wall (not shown) and a rear wall 308 of a unit frame 306. The toner holding chamber 326 is provided with a first holding chamber 328, a second holding chamber 320 and a mixing chamber 332. In the illustrated embodiment, a downwardly extending wall 334 is provided in the wall 314, and the first holding chamber 328 is defined by the walls 334, 312 and 314. Fresh toner (not shown) is held in the first holding chamber 328. In the illustrated embodiment, a toner cartridge 336 is loaded detachably into the first holding chamber 328 as shown in FIG. 9. When the supply of fresh toner is not necessary (for example, when the copying machine is of such a type that when the toner held in the first holding chamber 328 is used up, the entire process unit 302 is replaced), it is possible to define a discharge opening by the inner surface of the wall 312 and the lower end of the wall 334 and load fresh toner directly into the first holding chamber 328. The second holding chamber 330 is defined by a nearly U-shaped part **316*a* in the wall 316. In the illustrated embodiment, the second holding chamber 316*a* is substantially juxtaposed with the first holding chamber 328 as shown in FIG. 9. Because of this structure, the height of the developing device 304 can be reduced and the entire developing device can be made compact. The toner removed from the rotating drum 340 as described thereafter is fed to the second holding chamber 330. The mixing chamber 332 located below the first holding chamber 328 and the second holding chamber 330 is defined by the lower parts of the walls 312 and 316. A toner discharge opening 342 is formed at the bottom of the mixing chamber 332. The toner discharge opening 342 is formed substantially from one end to the other end of the mixing chamber 332 in its widthwise direction, and a slender cylindrical toner feed roller 344 is disposed in the toner discharge opening 342. The toner feed roller 344 is rotated in the direction shown by an arrow 346, and by this rotation, the toner in the mixing chamber 332 is fed to the developing chamber 322 through the toner discharge opening 342**.

A cleaning device 348 is also mounted on the unit frame 306 of the process unit 302, and toner feed means for conducting the toner recovered in the cleaning device 348 to the developing device 304 is also mounted on the unit frame 306. The illustrated toner feed means is nearly of the same structure as that in the first embodiment shown in FIGS. 1 to 8, and is provided with a hollow cylindrical member (not shown) and a helical member 350 constituting toner transfer means. As can be seen from FIG. 9, one end of the hollow cylindrical member is kept in communication with a toner recovery chamber 352 of the cleaning device 348, and its other end communicates with the second holding chamber 330 in the toner holding chamber 326 of the developing device 304. The helical member 350 is disposed within the hollow cylindrical member (not shown). Its one end portion **350*a* extends from the hollow cylindrical member into the toner recovery chamber 352 of the cleaning device 348. Its other end portion 350*b* extends from the hollow cylindrical member into the second holding chamber 330 of the developing device 304**.

Otherwise, the structure of the process unit 302 is substantially the same as in the first embodiment, and a detailed description thereof will be omitted. The process unit 302 may be detachably mounted on a supporting structure (the upper supporting frame in the first embodiment) of a copying machine in place of the process unit 16 in the first embodiment, for example.

When the rotating drum 340 is rotated in the direction shown by an arrow 354 in copying machine provided with the process unit 302 described above, the helical member 350 is rotated as is required. Specifically, its one end portion **350*a* located within the toner recovery chamber 352 is rotated in the direction shown by an arrow 356, and by the action of an elastic blade 358, the toner recovered from the rotating drum 340 is transferred from the rear end to the front end of the toner recovery chamber 352 by the action of the helical member 350. The toner so transferred is fed to the second holding chamber 330 of the developing device 304 via the hollow cylindrical member (not shown). The other end portion 350*b* located within the second holding chamber 330 is rotated in the direction of an arrow 360, and the toner fed into the second holding chamber 330 as described above is transferred from the front end toward the rear end of the second holding chamber 330 in the direction shown by an arrow 370 (FIG. 10) by the other end portion 350*b* rotating, in the direction of arrow 360. During transfer in the second holding chamber 330, the toner advances beyond the upper surface of one side end (the right side end in FIG. 9) of a nearly U-shaped wall portion 316*a* of the wall 316 by the action of the helical member 350. The toner which has advanced over the upper surface of the above one side end passes between the walls 316 and 334 and is fed to that site of the mixing chamber 332 which is above the site of the toner feed roller 344. Fresh toner supplied from the toner cartridge 336 through the discharge opening 362 exists in the mixing chamber 332. Hence, the toner fed from the second holdng chamber 330 for reuse is mixed with the fresh toner near the toner discharge opening 342 of the mixing chamber 332, and the mixed toner is fed to the developing chamber 322 by the action of the toner feed roller 344 via the toner discharge opening 342. The toner so fed is mixed with the developer present in the developing chamber 322 by the action of the agitating means 364, and fed to applicator means 366. In the second embodiment, the upper edge of one side end of the wall portion 316***a* beyond which the toner advances has a progressively decreasing height from the front end toward the rear end of the second holding chamber 330 as shown on an enlarged scale in FIG. 10. Hence, in the front end portion of the second holding chamber 330, the proportion of the toner fed is small in spite of the relatively large amount of the existing toner. On the other hand, in its rear end portion, the proportion of the toner fed is large in spite of the relatively small amount of the existing toner. As a result, the toner from the second holding chamber 330 is substantially uniformly fed in the widthwise direction of the mixing chamber 332.

In the illustrated embodiment shown in FIGS. 8 and 9, the upper edge of one side end of the wall portion 316*a* has a progressively lower height from the front end toward the rear end. Alternatively, the wall portion 316*a* may be constructed as wall portion 316*a'* shown in FIG. 11.

Figure 11:
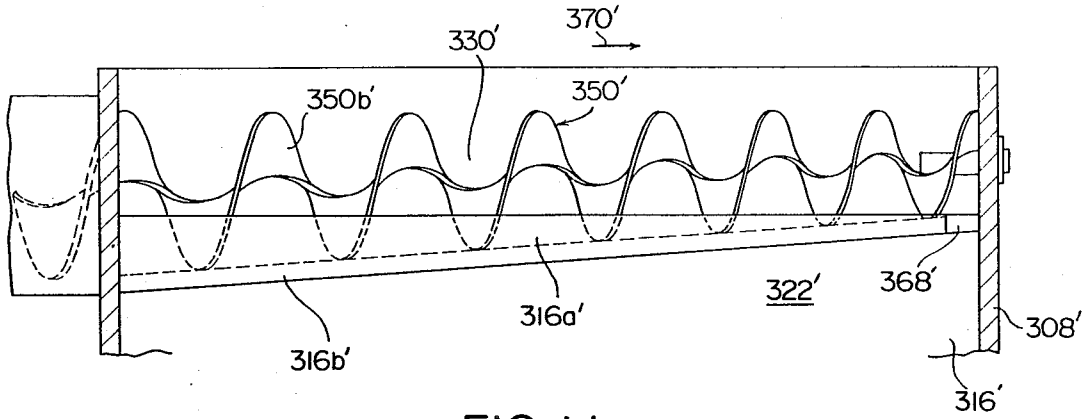
FIG. 11 is a sectional view of a second holding chamber and its vicinity in a modified example of the process unit of FIG. 8.

In FIG. 11, the part 316*a'* defining the second holding chamber 330' of the wall 316' has a nearly U-shaped bottom portion 316*b'*, and that part of the second holding chamber 330' which defines the bottom portion is raised from one end (front end) to the other end (rear end) of a mixing chamber 332' in the widthwise direction In other words, one side end of the wall portion 316*a'* beyond which the toner in the second holding chamber 330' advances has a progressively decreasing height from one end toward the other end of the mixing chamber 332' in the widthwise direction as a result of raising the bottom portion 316*b'*. In this case, too, the toner which is fed to the mixing chamber 332' beyond the upper edge of the aforesaid one side end of the wall portion 316*a* during transfer in the second holding chamber 330' is fed in a small proportion at the front end portion of the second holding chamber 330' in spite of the relatively large amount of the existing toner. On the other hand, at its rear end portion, the proportion of the toner fed is large in spite of the relatively small amount of the existing toner. As a result, the toner is fed substantially uniformly in the widthwise direction of the mixing chamber 332'.

In FIG. 11, the other end portion 350*b'* of the helical member 350' extends conically rearwardly in the frontrear direction, and in relation to this, the central axis of the other end portion 350*b'* is slightly inclined upwardly from the front end toward the rear end of the second holding chamber 330'. The same effect can be achieved by simply inclining the central axis of the other end portion 350*b'* slightly upwardly without rendering the other end portion 350*b'* conical.

Since in opening 368' is formed at the bottom of the rear end of the second holding chamber 330', the toner transferred to the rear end in the direction of arrow 370' in the second holding chamber 330' is fed into the mixing chamber 332' through the opening 368'.

In a copying apparatus equipped with the process unit 302, the toner from the second holding chamber 330 (330') is mixed with fresh toner from the first holding chamber 330 near the toner discharge opening 342 of the mixing chamber 332 (332'), and the mixed toner is fed into the developing chamber 322 through the toner discharge opening 342. Hence, the toner for reuse is fed into the developing chamber 322 in a fixed proportion. Hence, stable images can be obtained over a long period of time while inhibiting degradation of image quality.

Outline of Electrostatic Copying Machine in Third Embodiment

Now, with reference to FIGS. 12 to 18, a third embodiment of an electrostatic copying machine as one example of the image forming machine in accordance with this invention will be described.

Figure 12:
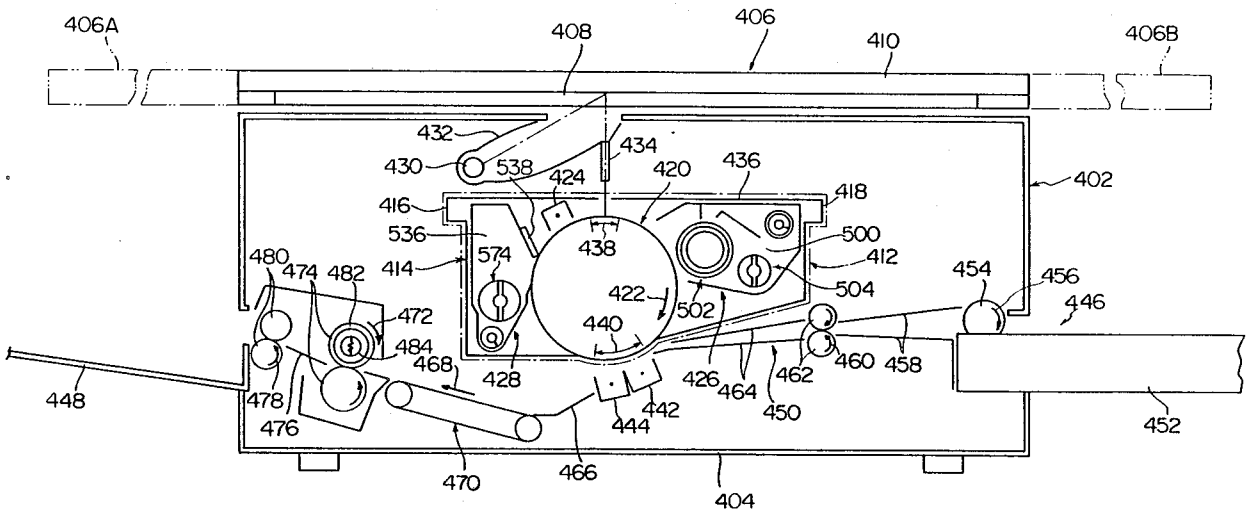
FIG. 12 is a simplified sectional view showing a third embodiment of electrostatic copying machine as one example of the image forming machine constructed in accordance with this invention.

With reference to FIGS. 12, the illustrated copying machine has a nearly parallelepipedal housing shown generally at 402. The housing 402 is defined by a bottom wall 404 and a vertical front base plate and a vertical rear base plate (not shown) disposed between the front end portion and the rear end portion of the bottom wall 404 in spaced-apart relationship in the front-rear direction (the direction perpendicular to the sheet surface in FIG. 12), and various constituent elements to be described are disposed between the vertical front base plate and the vertical rear base plate.

Document placing means 406 is mounted on the upper surface of housing 402 for reciprocating movement in the left-right direction. The document placing means 406 includes a transparent plate 408 on which to place a document to be copied and an openable and closable document cover 410 for covering the transparent plate 408 and the document on it.

A process unit shown generally at 412 is detachably mounted on the nearly central part of the housing 402. A pair of supporting rails (not shown) extending in a direction perpendicular to the sheet surface in spaced-apart relation-ship in the left-right direction are fixed to the housing 402. The process unit 412 has a unit frame 414, and portions 416 and 418 to be supported extending in a direction perpendicularly to the sheet surface are formed on the left and right sides of the unit frame 414. Hence, the process unit 412 is mounted on, and detached from, the housing 402 (supporting structure) by engaging the portions 416 and 418 with the supporring rail portions (not shown) provided in the housing 402 and sliding the unit frame 414 in the direction perpendicular to the sheet surface. A rotating drum 420 constituting image-bearing means is rotatably mounted on the nearly central portion of the unit frame 414. A suitable electrostatographic material is disposed on the peripheral surface of the rotating drum 420. Around the rotating drum 420 to be rotated in the direction shown by an arrow 422 are mounted a charging corona discharge device 424, a developing device shown generally at 426, and a cleaning device shown generally at 428 in this sequence as viewed in the rotating direction of the drum 420. The process unit 412, particularly, the developing device 426, the cleaning device 428 and elements related thereto will be described in detail hereinafter.

A document illuminating lamp 430, a reflecting plate 432 and an optical system 434 positioned above the process unit 412 are also disposed within the housing 402. The light from the illuminating lamp 430 travels through the transparent plate 408 and illuminates a document placed on it, as shown by a two-dot chain line. The light reflected from the document travels through the optical system 434 and an exposure opening formed in the upper wall 436 of the unit frame 414 and is projected onto the peripheral surface of the rotating drum 420 in an exposure zone 438.

Below the rotating drum 420 are disposed a transfer corona discharge device 442 adapted to face the peripheral surface of the rotating drum 420 in a transfer zone 440, and a peeling corona discharge device 444 adjacent to, and downstream of, the transfer corona discharge device 442.

A copying paper feed means shown generally at 446 is disposed in the right end portion of the housing 402, and a copying paper receiving tray 448, at the left end portion of the housing 402. A copying paper conveying system shown generally at 450 is disposed between the paper feed means 446 and the paper receiving tray 448 for conveying copying paper through the transfer zone 440. The paper feed means 446 is provided with a cassette receiving section, a copying paper cassette 452 detachably mounted on the cassette receiving section, and a delivery roller 454 disposed above the cassette-receiving section. Copying paper sheets are received in the stacked state in the paper cassette 452. When the delivery roller 454 is rotated in the direction shown by an arrow 456, the paper sheets in the cassette 452 are delivered one by one. The paper so delivered advances between a pair of guide plates 458 and is fed to the paper conveying system 450. The paper conveying system 450 comprises a pair of conveyor rollers 462 to be rotated in the direction shown by an arrow 460, a pair of guide plates 464, a guide plate 466, a conveyor belt mechanism 470 to be rotated in the direction shown by an arrow 468, a heat fixing roller pair 474 to be rotated in the direction shown by an arrow 472, a guide plate 476 and a pair of discharge rollers 480 to be rotated in the direction shown by an arrow 478. The upper heating roller 482 of the heat fixing roller pair 474 has a suitable heating means 484 disposed therein. The operation of the electrostatic copying apparatus in accordance with the third embodiment is substantially the same as in the first embodiment shown in FIGS. 1 to 8.

Process Unit in the Electrostatic Copying Machine in the Third Embodiment

Figure 13:
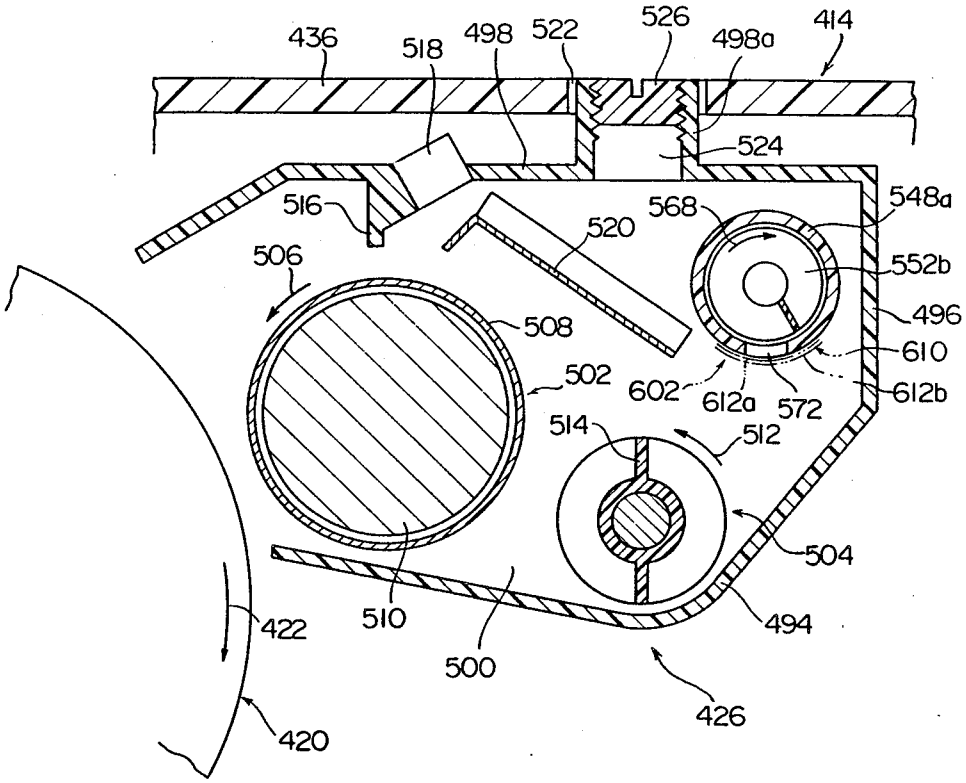
FIG. 13 is an enlarged sectional view showing a developing device and its vicinity in the electrostatic copying machine of FIG. 12.
Figure 14:
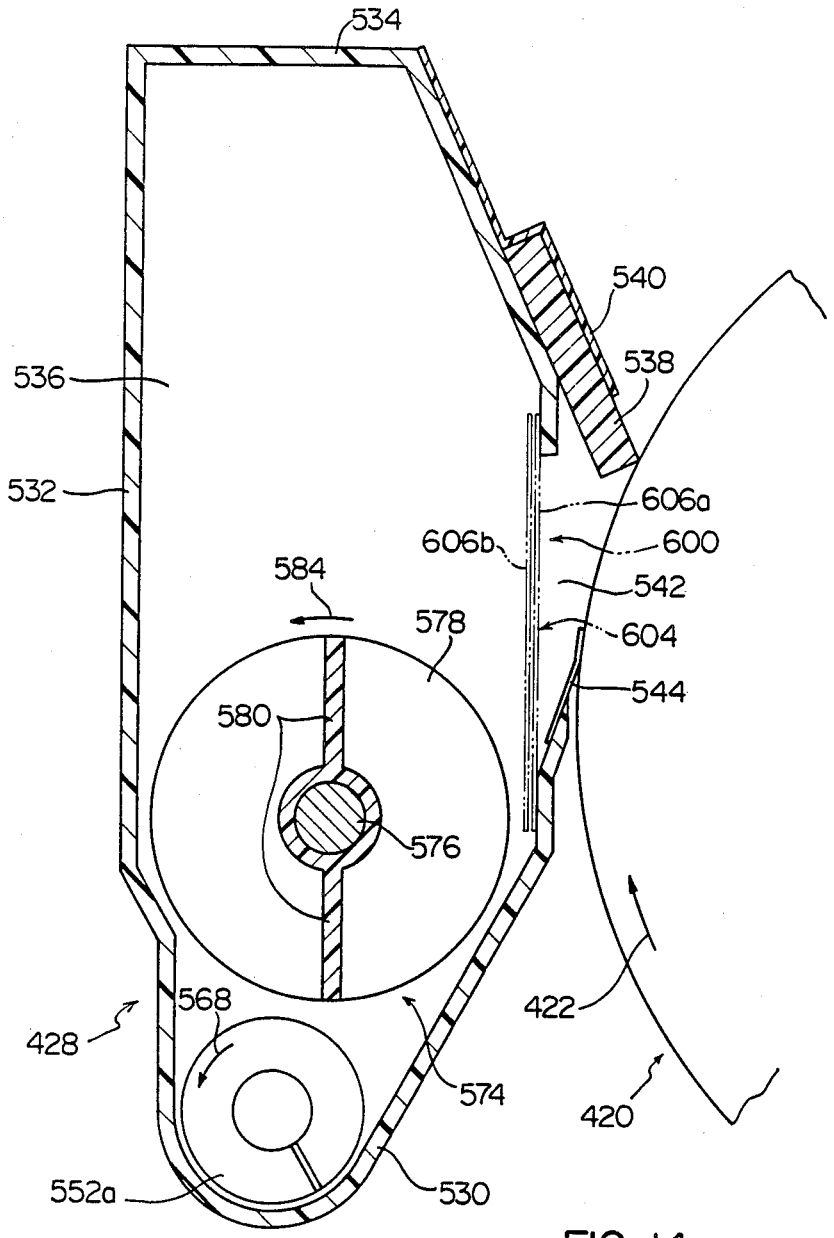
FIG. 14 is an enlarged sectional view showing a cleaning device and its vicinity in the electrostatic copying machine of FIG. 12.
Figure 15:
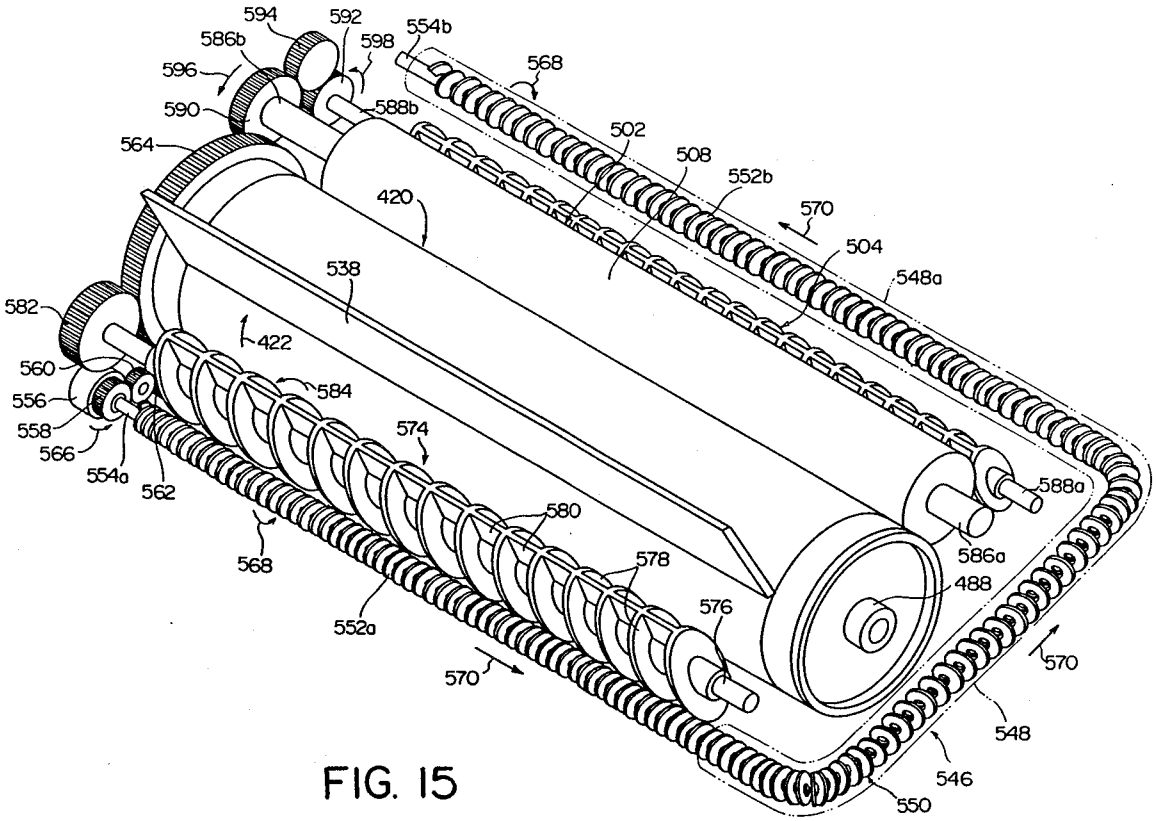
FIG. 15 is a perspective view showing toner feed means and elements related thereto in the electrostatic copying machine of FIG. 12 and the vicinity of the discharge opening sealing means.

With reference to FIGS. 13 to 15 in conjunction with FIG. 12, the unit frame 414 of the illustrated process unit 412 has a front wall 486 (partly shown in FIGS. 17 and 18) and a rear wall (not shown) spaced from each other in the front-rear direction (the direction perpendicular to the sheet surface in FIGS. 12 to 14, and the direction from right bottom to left top in FIG. 15), and the rotating drum 420, the developing device 426 and the cleaning device 428 are disposed between the front wall 486 and the rear wall.

Shaft portions 488 (only one of which is shown in FIG. 15) are provided in oposite end portions of the rotating drum 420 and supported rotatably on the front wall 486 and the rear wall (not shown). The other shaft portion (not shown) of the rotating drum 420 is drivingly connected to a driving source such as an electric motor. Hence, the rotating drum 420 is rotated in the direction of arrow 422 by the action of this driving source (not shown).

Figures 17, 18:
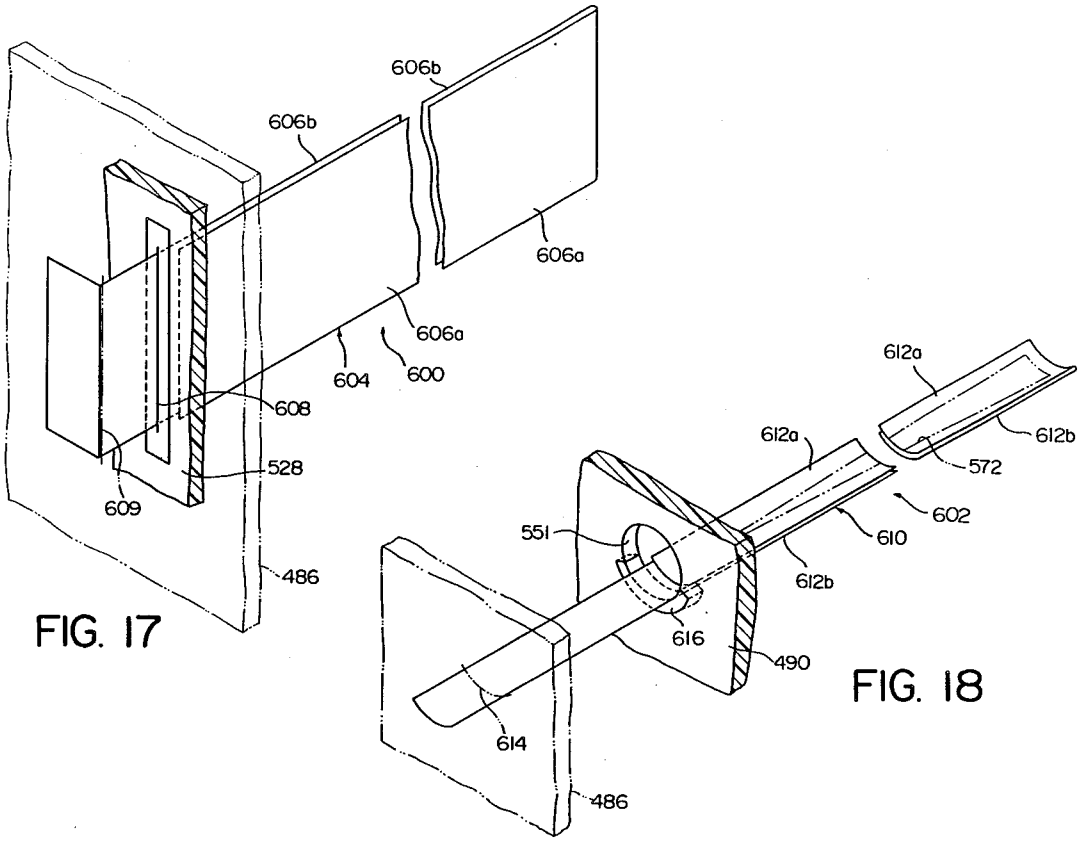
FIG. 17 is a perspective view, partly in section, showing sealing means disposed in a recovery opening in a toner recovery chamber in the electrostatic copying machine of FIG. 12 and the vicinity of the sealing means.
FIG. 18 is a perspective view showing, partly in section, a discharge opening sealing means disposed in a toner discharge opening formed in the hollow guide member in the electrostatic copying machine of FIG. 12 and the vicinity of the discharge opening.

With reference mainly to FIG. 13, the illustrated developing device 426 has a front end wall 490 and a rear end wall 492 (FIG. 16 partly shows the front end wall 490 and the rear end wall 492, and FIGS. 17 and 18 show part of the front end wall 490) spaced from each other in the front-rear direction inwardly of the front wall 486 and the rear wall (not shown) of the unit frame 414. Walls 494, 496 and 498 are provided between the front end wall 490 and the rear end wall 492. The illustrated developing device 426 is provided with a developing chamber 500 defined by the front end wall 490, the rear end wall 492, and the walls 494, 496 and 498. The developing chamber 500 is open at its left side surface facing the rotating drum 420, and applicator means 502 is disposed in the left portion of the developing chamber 500. Developer agitating means 504 is disposed in the right bottom portion of the developing chamber 500. The illustrated applicator means 502 is comprised of a hollow cylindrical sleeve 508 to be rotated in the direction shown by an arrow 506 and a stationary permanent magnet 510 disposed within the sleeve 508. The stationary permanent magnet 510 has a plurality of circumferentially spaced magnetic poles. The agitating means 504 has a plurality of vane members 514 to be rotated in the direction shown by an arrow 512. These vane members 514 agitate a developer within the developing chamber 500 and feed it to the applicator means 502. Brush cutting means 516 projecting toward the sleeve 508 of the applicator means 502 is provided in the inside surface of the left portion of the wall 498 of the developing chamber 500. The brush cutting means 516 acts on the developer moving while being magnetically held onto the surface of the sleeve 508, and removes the excess of the developer. A toner concentration detector 518 located above the brush cutting means 516 is disposed in the wall 498. The detector 518, which may be of a known type, has a detecting surface exposed to the inside of the developing chamber 500, and detects the toner concentration of the developer removed from the applicator means 502 by the action of the brush cutting means 516. Within the developing chamber 500, a guide member 520 is further provided above the applicator means 502. The guide member 520 is inclined downwardly to the right, and conducts the excess of the developer removed from the applicator means 502 to the agitating means 504. In the illustrated embodiment, a feed opening portion **498*a* for feeding a starting developer is provided in the nearly central part of the wall 498. The feed opening portion 498*a* slightly projecting upwardly is exposed to the outside of the unit frame 414 through an opening 522 formed in the upper wall 436 of the unit frame 414. A sealing member 526 for openably closing a feed port 524 is threadedly secured to the feed opening portion 498*a*. In use, the sealing member 526 is removed, and the starting developer (developer composed of a mixture of carrier and toner in a predetermined ratio) is fed to the developing chamber 500 through the feed port 524**.

With reference mainly to FIG. 14, the illustrated cleaning device 428 has a front end wall 528 (partly shown in FIG. 17) and a rear end wall (not shown) spaced from each other in the aforesaid front-rear direction inwardly of the front wall 486 and the rear wall (not shown) of the unit frame 414, and walls 530, 532 and 534 are provided between the front end wall 528 and the rear end wall. The cleaning device 428 is provided with a toner recovery chamber 536 defined by the front end wall 528, the rear end wall, and the walls 530, 532 and 534. The cleaning device 428 is equipped with an elastic blade 538 acting as toner removing means, and the elastic blade 538 is attached to the outside surface of the right end portion of the wall 534 by a fixing member 540. The free end portion of the elastic blade 538 is kept in press contact with the photosensitive surface of the rotating drum 420 and removes the residual toner from the surface of the photosensitive material. Part of the right side surface of the toner recovery chamber 536 which faces the rotating drum 420 is open, and a seal member 544 which may be formed of a synthetic resin film disposed on the inside surface of the wall 530 defining the lower edge of a recovery opening 542 formed in the toner recovery chamber 536. The seal member 544 extends toward the rotating drum 420 from its one end portion fixed to the wall 530, and its other end is in contact with, or in proximity to, the peripheral surface of the rotating drum 420. The seal member 544 serves to conduct the toner removed by the action of the elastic blade 538 to the toner recovery chamber 536.

Figure 16:
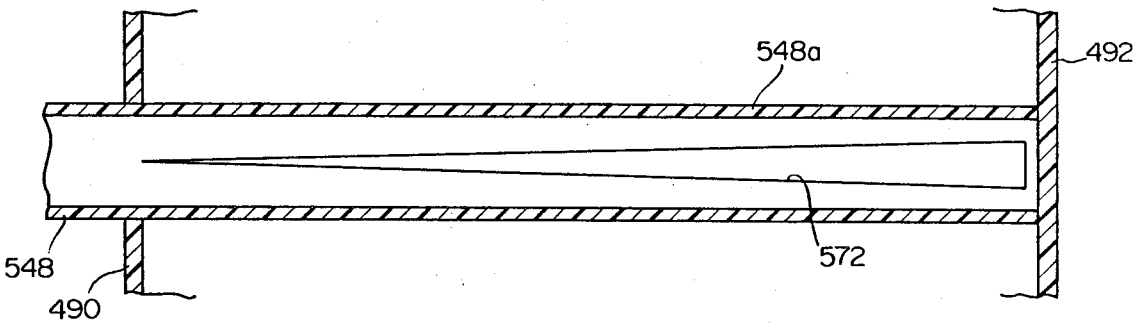
FIG. 16 is a sectional view showing a toner discharge opening, as viewed from above, formed in a hollow guide member provided in the developing device in the electrostatic copying machine shown in FIG. 12.

In the electrostatic copying machine described above, fresh toner (which has never been used for development) is sealed up in the toner recovery chamber 536 during production of the machine. In relation to this feature, the copying machine is constructed as follows. With reference mainly to FIGS. 13 to 15, the process unit 414 further includes toner feed means 546 for transferring the toner in the toner recovery chamber 536 of the cleaning device 428 to the developing chamber 500 of the developing device 426. The illustrated toner feed means 546 is provided with a hollow cylindrical member 548 (shown by two-dot chain line in FIG. 15) and a helical member 550 disposed rotatably in the hollow cylindrical member 548. An opening is formed at a required site of the front wall 528 (FIG. 17) of the cleaning device 428, and another opening 551 (FIG. 18) is formed at a required site of the front end wall 490 of the developing device 426. One end of the hollow cylindrical member 548 is connected to the above opening formed in the front end wall 528 of the cleaning device 428, and its other end portion is connected to the opening 551 formed in the front end wall 490 of the developing device 426. In the illustrated embodiment, the other end portion of the hollow cylindrical member 548 extends through the opening 551, and via the right upper portion of the developing chamber 500, terminates in the rear end wall (see FIG. 16). In the illustrated embodiment, the other end portion of the hollow cylindrical member 548 (more specifically, its part 548*a* located between the front end wall 490 and the rear end wall 492 of the developing device 426) acts as a hollow guide member. Alternatively, it is possible to form a separate hollow cylindrical guide member, mount it between the front end wall 490 and the rear end wall 492 of the developing device 426, and cause the other end portion of the hollow cylindrical member 548 to communicate with the hollow guide member. One end portion 552*a* of the helical member 550 disposed within the hollow cylindrical member 548 is positioned in the toner recovery chamber 536 of the cleaning device 428. More specifically, one end portion 552*a* of the helical member 550 extends to the toner recovery chamber 536 through the above opening formed in the front end wall 528 (FIG. 17) of the cleaning device 428, and in the bottom portion of the toner recovery chamber 536, extends in the widthwise direction of the toner recovery chamber 536, i.e. in the aforesaid front-rear direction, substantially from its one end to the other. A shaft portion 554*a* provided at its one end is rotatably mounted on the rear end wall (not shown) of the cleaning device 428. The shaft portion 554*a* projects rearwardly through the rear end wall, and a gear 558 is mounted to this projecting end via clutch means 556 such as an electromagnetic clutch. The gear 558 meshes with a large gear 564 provided in the rear end portion of the rotating drum 420 via gears 560 and 562. Because of this driving connection, when the rotating drum 420 is rotated in the direction of arrow 422, the gear 558 is rotated in the direction shown by an arrow 566 via the gears 562 and 560. When the clutch means 556 is energized, the driving force of the gear 558 is transmitted to the shaft portion 554*a* of the helical member 550 via the clutch means 556. The other end portion 552*b* of the helical member 550 extends axially through the inside of the hollow cylindrical member 548. Specifically, the other end portion 552*b* positioned in the developing chamber 500 extends in the widthwise direction of the developing chamber 500, namely in the aforesaid front-rear direction, substantially from one end to the other of the other end portion 548*a* positioned between the front end wall 490 and the rear end wall 492 (FIG. 16) of the hollow cylindrical member 548. The shaft portion 554*b* provided in its other end is rotatably mounted on the rear end wall 492 of the developing device 426. As shown in FIG. 15, the illustrated helical member 550 has shaft portions 554*a* and 554*b* at its opposite ends, but the remainder has no shaft portion and is hollow while being wound helically in a predetermined direction. When the driving force of the gear 558 in the direction of arrow 566 is transmitted to the helical member 550 via the clutch means 556, the helical member 550 rotates in the direction of arrow 568 and transfers the toner from its one end to the other in the direction shown by an arrow 570. A toner discharge opening 572 (FIGS. 13 and 16) for feeding the toner transferred by the action of the helical member 550 to the developing chamber 500 is formed in the lower portion of the aforesaid other end portion 548*a* (that part which is positioned in the developing chamber 500) of the hollow cylindrical member 548. In the illustrated embodiment, the toner discharge opening 572 extends substantially from one end to the other of the aforesaid other end portion 548*a* of the hollow cylindrical member 548 as shown in FIG. 16. The opening width of the toner discharge opening 572 preferably increases progressively in a nearly triangular shape in the toner transferring direction shown by arrow 570.

Agitating means 574 is disposed in the toner recovery chamber 536 of the cleaning device 428. The illustrated agitating means 574 has a shaft member 576. A plurality of axially spaced nearly circular vane members 578 are disposed slightly inclinedly on the shaft member 576, and nearly rectangular vane members 580 are provided among the vane members 578. The agitating means 574 is disposed above one end portion 552*a* of the helical member 550 of the toner recovery chamber 536, and both end portions of the shaft member 576 are rotatably mounted on a front end wall 528 and a rear end wall (not shown) of the cleaning device 428. The rear end portion of the shaft member 576 projects rearwardly through the rear end wall, and a gear 582 is mounted on its projecting end. The gear 582 meshes with a large gear 562 provided in the rotating drum 420. Hence, rotating of the rotating drum 420 in the direction of arrow 422 causes rotation of the agitating means 574 in the direction of arrow 584 via the large gear 562 and the gear 582. The agitating means 574, as will be described hereinafter, mixes a fresh toner filled beforehand in the toner recovery chamber 536 with the toner used for development and recovered in the toner recovery chamber 536. To perform the mixing of the fresh toner and the recovered toner conveniently, it is preferred, as shown in FIG. 14, to provide the agitating means 574 immediately above one end portion 552*a* of the helical member 550 and in a falling and recovering path for the recovered toner removed from the rotating drum 420, and also to decrease the distance between the agitating means 574, particularly the nearly circular vane members 578 in the illustrated embodiment, and the walls 530 and 532 defining the toner recovery chamber 536.

As shown in FIG. 15, in the sleeve 508 of the applicator means 502, too, shaft portions 586*a* and 586*b* provided at its opposite end portions are rotatably mounted on the front end wall 490 and the rear end wall 492 of the developing device 426. In the agitating means 504, too, shaft portions 588*a* and 588*b* provided at its opposite end portions are rotatably mounted on the front end wall 490 and the rear end wall 492. The shaft portion 586*b* of the sleeve 508 projects rearwardly through the rear end wall 492 (FIG. 16), and a gear 590 is mounted on its projecting end. The shaft portion 588*b* of the agitating means 504 also projects rearwardly through the rear end wall 492, and a gear 592 is mounted on its projecting end. The gears 590 and 592 are drivingly connected via a small gear 594. When the gear 590 is rotated in the direction shown by an arrow 596 by the driving source (not shown) of the copying machine (whereby the sleeve 508 is rotated in the direction of arrow 506), the gear 592 is rotated in a direction shown by an arrow 598 via the gear 594 (whereby the agitating means 504 is rotated in the direction of arrow 512).

In relation to the fact that fresh toner is filled beforehand in the toner recovery chamber 536 of the cleaning device 428, it is preferred to provide openable sealing means 600 (FIGS. 14 and 17) in the recovery opening 542 of the toner recovery chamber 532. It is more preferred to provide openable discharge opening sealing means 602 (FIGS. 13 and 18) in the toner discharge opening 572 formed in the other end portion 548*a* of the hollow cylindrical member 548.

With reference to FIGS. 14 and 17, the illustrated sealing means 600 is comprised of a relatively thin plastic seal member 604 and detachably bonded to the recovery opening 542 of the toner recovery chamber 536 by means of an adhesive, for example. Preferably, the seal member 604 is bonded as shown in FIGS. 14 and 17. Specifically, one end of the seal member 604 is applied to the inside surface of the front end wall 523 of the cleaning device 428, and the upper end portion of its one end portion 606*a* extending from the aforesaid one end toward the rear end wall (not shown). The lower end portion of the one end portion 606*a* is applied to the inside surface of the wall 530. Thus, the recovery opening 542 is substantially sealed by the aforesaid one end portion 606*a* of the seal member 604. To permit easy detachment of the seal member 604, the other end portion 606*b* of the seal member 604 which further extends from the one end portion 606*a* is folded to the side of the toner recovery chamber 532 (to the left in FIGS. 14 and 17) and positioned overlappingly on the inside of the one end portion 606*a*, and the other end of the seal member 604 is slightly projected forwardly of the front wall 486 through an elongate hole 608 formed in the front end wall 528 and an elongate hole 609 formed in the front wall 486 of the unit frame 414. The other end of the seal member 604 may be bent and detachably bonded to the front surface of the front wall 486 of the unit frame 414 by means of, for example, a tape, or may be left as it is. It will be readily understood that when the seal member 604 is so bonded, the entire seal member 406 can be removed from the recovery opening 542 by forwardly pullng its other end projecting from the front wall 486.

With reference to FIGS. 13 and 18, the discharge opening sealing means 602 is comprised of a relatively thin plastic seal member 610, and detachably bonded to the toner discharge opening 572 formed in the other end portion 548*a* of the hollow cylindrical member 548 by means of, for example, an adhesive. Like the seal member 604, the seal member 610 is also preferably bonded as shown in FIGS. 13 and 18. Specifically, one end portion 612*a* of the seal member 610 located inwardly of the front end wall 490 of the developing device 426 which extends from its one end toward the rear end wall 492 is applied to the outside surface of the other end portion 548*a* of the hollow cylindrical member 548 to seal the toner discharge opening 572 substantially by this one end portion 612*a*. To permit easy detachment of the sealing member 610, the other end portion 612*b* of the seal member 610 which further extends from the one end portion 612*a* is folded to the side of the developing chamber 500 (downwardly in FIGS. 13 and 18) and positioned overlappingly beneath the one end portion 612*a*. The other end of the seal member 610 is slightly projected forwardly of the front wall 486 through the circular opening 551 (the other end portion of the hollow cylindrical member 548 is to be inserted into this opening 551) formed in the front end wall 490 and an elongate arcuate hole 614 formed in the front wall 486 of the unit frame 414. The other end of the seal member 610 may be left in the projecting state as shown in the illustrated embodiment, but may, as desired, be bent and detachably bonded to the front surface of the front wall 486 as is the case with the seal member 604. When the seal member 610 is so bonded, the entire seal member 610 can be removed from the toner discharge opening 572 by forwardly pulling its other end projecting from the front wall 486. In bonding the seal member 610 in the above manner, it is preferred to provide it at that part of the opening 551 formed in the front end wall 490 of the developing device 426 which defines at least the lower part of the opening 551. In the illustrated embodiment, a nearly semi-arcuate seal member 616 is provided at that part of the opening 551 of the front end wall 490 which defines its lower part. The seal member 616 can be formed of, for example, rubber, and serves to close the space between the front end wall 490 and the hollow cylindrical member 548 after detachment of the seal member 610, and thus prevent the developer in the developing chamber 500 from leaking outside through the opening 551.

Again with reference mainly to FIGS. 13 to 15, when the electrostatic copying machine described above is to be started, a starting developer is loaded in the developing chamber 500 of the developing device 426 and the seal member 604 sealing the recovery opening 542 of the toner recovery chamber 536 of the cleaning device 428 and the seal member sealing the toner discharge opening 572 formed in the other end portion 548*a* of the hollow cylindrical member 548 are detached. Loading of the starting developer can be achieved by detaching the sealing member 526 threadedly secured to the feed opening portion 498*a* provided in the wall 498 of the developing device 426, and feeding the starting developer held in a receptacle (not shown) to the developing chamber 500 through the feed opening 524 from the receptacle. Detachment of the seal member 604 can be achieved by peeling the other end of the seal member 604 bonded to the front wall 486 of the unit frame 414, and peeling its one end portion 606*a* from the recovery opening 542 of the toner recovery chamber 536 while pulling the other end forwardly (see FIG. 17 also). As a result, the seal member 604 can be removed through the opening 608 formed in the front end wall 528 of the cleaning device 428 and the opening 609 formed in the front wall 486 of the unit frame 414, and the recovery opening 542 of the toner recovery chamber 536 is maintained open. Detachment of the seal member 610 can be achieved by peeling its one end portion 612*a* from the toner discharge opening 572 formed in the other end portion 548*a* of the hollow cylindrical member 548 while forwardly pulling its other end slightly projecting from the front wall 486 of the unit frame 414 (see FIG. 18 also). As a result, the seal member 610 can be removed through the opening 551 formed in the front end wall 490 of the developing device 426 and the opening 614 formed in the front wall 486 of the unit frame 414, and the toner discharge opening 572 formed in the hollow cylindrical member 548 is maintained open. The foregoing operations render the copying machine ready for copying. The copying machine described above has the following noteworthy features.

Before starting the copying operation, the recovery opening 542 of the toner recovery chamber 536 (in which fresh toner is loaded in advance during machine production) is sealed up with the seal member 604, and the toner discharge opening 572 of the hollow cylindrical member 548 which permits communication between the toner recovery chamber 536 and the developing chamber 500 is also sealed with the seal member 610. It is possible therefore to accurately prevent leakage of the fresh toner loaded in the toner recovery chamber 536 during transportation of the electrostatic coying machin or the process unit.

At the time of copying, the agitating means 504 is rotated in the direction of arrow 512 in the developing device 426. As a result, the developer is agitated and the toner is charged to a particular polarity. The developer so agitated is fed to the applicator means 502. The sleeve 508 in the applicator means 502 is rotated in the direction of arrow 506, and the developer fed by the action of the agitating means 504 is held onto the surface of the sleeve 508 by the magnetic attracting force of the magnet 510 disposed within the sleeve 508 and is moved in the direction of arrow 506 as the sleeve 508 rotates. The excess of the developer held on the surface of the sleeve 508 is removed by the action of the brush cutting means 516. The removed developer is moved upwardly along the inside surface of the wall 498 and then caused to flow downwardly toward the agitating means 504 on the guide plate 520. In the meantime, the developer held on the surface of the sleeve 508 and further conveyed in the direction of arrow 506 is brought into contact with the photosensitive material disposed on the surface of the rotating drum 420. The toner in the developer is applied to the photosensitive material in a pattern corresponding to the latent electrostatic image formed on it to thereby develop the latent electrostatic image to a toner image. When the toner concentration of the developer decreases as a result of the above development, the detector 518 produces a signal. Based on the signal, the clutch means 556 is energized, and the toner in the toner recovery chamber 536 is fed to the developing chamber 500.

When at the time of copying, the rotating drum 420 is rotated in the direction of arrow 422, the toner remaining on the photosensitive material is removed by the action of the elastic blade 538 provided in the cleaning device 428 since the free end portion of the elastic blade 538 is kept in press contact with the surface of the photosensitive material on the rotating drum 420. The removed toner is guided by the seal member 544 and via the recovery opening 542, recovered in the toner recovery chamber 536. Furthermore, when the rotating drum 420 is rotated in the direction of arrow 422, the agitating means 574 is rotated in the direction of arrow 584 via the large gear 564 and the gear 582. Thus, the fresh toner loaded in advance in the toner recovery chamber 536 and the recovered toner in the toner recovery chamber 536 are mixed substantially uniformly by the action of the agitating means 574, and marked degradation of copied images can be prevented. Hence, the recovered toner is mixed with the fresh toner and fed to the developing chamber 500 for reuse as will be described hereinafter.

When the clutch means 556 is energized on the basis of the signal from the detector 518, the rotational driving force of the gear 558 rotating in the direction of arrow 566 with the rotating of the rotating drum 420 is transmitted to the helical member 550 via the clutch means 556 to rotate the helical member 550. Specifically, its one end portion 552*a* located in the toner recovery chamber 536 is rotated counterclockwise as shown by arrow 568 (FIG. 14). and the toner present at the bottom of the toner recovery chamber 536 (which is mixed by the action of the agitating means 574 with the fresh toner) is transferred in the direction of arrow 570 forwardly in the aforesaid front-rear direction in the toner recovery chamber 536 by the action of the helical member 550. The toner so transferred further advances through the hollow cylindrical member 548 and is fed to the developing device 426. The other end portion 552*b* of the helical member 550 disposed within the other end portion 548*a* of the hollow cylindrical member 548 is rotated clockwise (FIG. 2) as indicated by arrow 568, and the toner conveyed to the developing device 426 is transferred in the direction shown by arrow 570 rearwardly in the aforesaid front-rear direction in the other end portion 548*a* by the action of the helical member 550. The toner so transferred is fed to the developing chamber 500 through the toner discharge opening 572 formed in the other end portion 548*a* of the hollow cylindrical member 548. The toner so fed is mixed with the developer present in the developing chamber 500 by the action of the agitating means 504.

Since in the illustrated embodiment, the toner discharge opening 572 has a progressively increasing width in the toner transferring direction indicated by arrow 570 as shown in FIG. 16, the proportion of the toner fed is small at one end portion (the left end portion in FIG. 16) of the toner discharge opening 572 in spite of the transferring of a relatively large amount of the toner. On the other hand, at the other end portion (the right end portion in FIG. 16), the proportion of the toner fed is large in spite of the transferring of a relatively small amount of the toner. Accordingly, the toner fed from the toner recovery chamber 536 is fed substantially uniformly in the widthwise direction of the developing chamber 500 through the toner discharge opening 572.

The third embodiment is of such a structure that the starting developer is loaded into the developing chamber 500 of the developing device 726 from outside at the time of copying. Alternatively, the machine may be constructed such that the starting developer is loaded in advance in the developing chamber 500 during machine production. In this case, that opening of the developing chamber 500 which faces the rotating drum 420 is preferably sealed detachably with a seal member, for example.

Process Unit in Electrostatic Copying Machine in Fourth Embodiment

Now, the process unit in a fourth embodiment of the electrostatic copying machine as one example of the image forming machine in accordance with this invention will be described with reference to FIGS. 19 and 20. This process unit results from improvement of the developing device and the cleaning device in the third embodiment shown in FIGS. 12 to 18.

Figure 19:
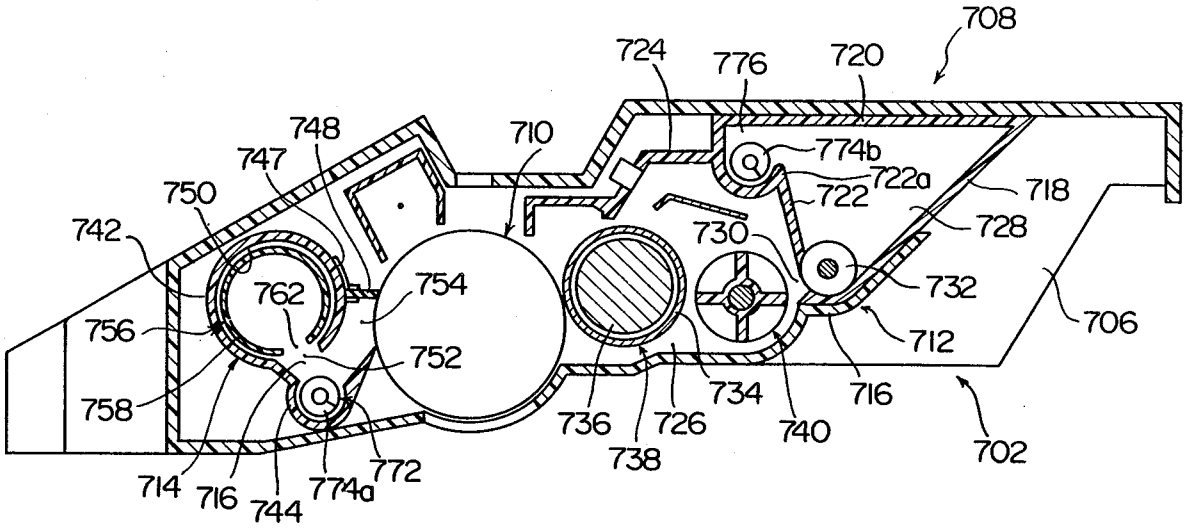
FIG. 19 is a sectional view showing a process unit in a fourth embodiment of electrostatic copying machine as one example of the image forming machine constructed in accordance with this invention.
Figure 20:
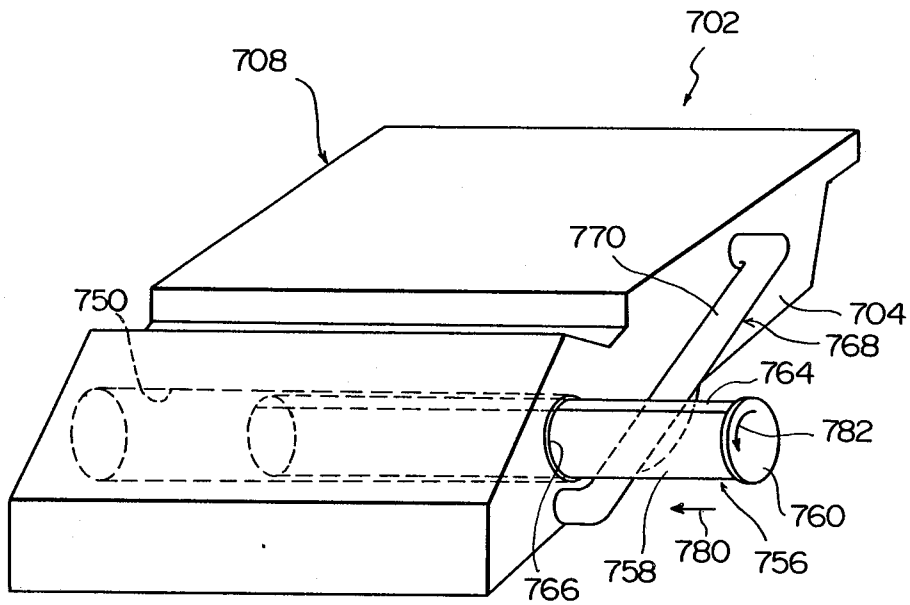
FIG. 20 is a perspective view showing the state in which a toner cartridge is mounted on a cleaning device in the process unit shown in FIG. 19.

With reference mainly to FIG. 19, the illustrated process unit 702 is provided with a unit frame 708 having a front wall 704 (FIG. 20) and a rear wall 706 (FIG. 19) spaced from each other in the front-rear direction, and a rotating drum 710, a developing device 712 and a cleaning device 714 are mounted in position on the unit frame 708.

The developing device 712 has walls 716, 718, 720, 722 and 724 fixed between the front wall 704 and the rear wall 706, and is provided with two chambers defined by these walls, namely a developing chamber 726 and a developer holding chamber 728. At the bottom of the developer holding chamber 728, a discharge opening 730 is formed substantially along its entire width, and a cylindrical feed roller 732 is disposed in the discharge opening 730. The developer holding chamber 728 is loaded with a developer (i.e., a starting two-component developer composed of carrier and toner in a predetermined mixing ratio, or a one-component developer composed only of toner) in advance during machine production. The developing chamber 726 has a provided therein a magnetic brush mechanism 738 consisting of a hollow sleeve 734 and a permanent magnet 736 disposed in the hollow sleeve 734, and agitating means 740 for agitating and mixing the developer present in the developing chamber 726.

The cleaning device 714 has walls 742 and 744 and is provided with a toner recovery chamber 746 defined by these walls 742 and 744. A fixing member 747 is attached to the outside surface of the wall 742, and an elastic blade 748 constituting toner removing means is secured to the fixing member 747. In the illustrated embodiment, the wall 742 defines a cylindrical cartridge receiving space 750 in the upper portion of the toner recovery chamber 746. The bottom of the cartridge receiving space 750 is open substantially along its entire width so that new toner is supplied as will be mentioned below through this opening 752. The free end of the wall 744 extends toward the rotating drum 710, and a recovery opening 754 is defined between the free end of the wall 744 and one end portion of the wall 742. Hence, the toner removed from the rotating drum 710 by the action of the elastic blade 748 is guided by the free end portion of the wall 744 through the recovery opening 754 and recovered at the bottom of the toner recovery chamber 716.

In this embodiment, a toner cartridge 756 for supplying fresh toner to the developing chamber 726 of the developing device 712 can be loaded into the cartridge receiving space 750 of the cleaning device 714. With reference to FIG. 20, the illustrated toner cartridge 756 has a hollow cylindrical side wall 758 and end walls 760 for closing both end surfaces of the side wall 758. An elongate discharge opening 762 (FIG. 19) is formed in the side wall 758 substantially along its entire length. During machine production, fresh toner is loaded into the toner cartridge 756 from the discharge opening 762, and then the toner discharge opening 762 is sealed with a suitable seal member 764 (FIG. 20). A circular opening 766 (FIG. 20) is formed at a given site of the front wall 704 of the unit frame 708, and the toner cartridge 756 is loaded into the cartridge receiving space 750 of the cleaning device 714 through the opening 766. Preferably, the toner cartridge 756 is constructed such that it can be detachably loaded into the cartridge receiving space 750, and after the toner in the cartridge 756 is used up, the cartridge 756 is replaced by a new toner cartridge. This requires a work of replacing the cartridge, but the cartridge receiving space 750, and therefore, the cleaning device 714, can be reduced in size.

The process unit 702 further includes toner feed means 768 for feeding the toner in the recovery chamber 716 of the cleaning device 714 to the developing device 712. The illustrated toner feed means 768 is of substantially the same structure as that in the second embodiment shown in FIGS. 9 and 10, and includes a hollow cylindrical member 770 and a helical member 772 disposed in the hollow cylindrical member 770. With reference to FIGS. 19 and 20, one end of the hollow cylindrical member 770 communicates with the bottom of the toner recovery chamber 716 of the cleaning device 714 through one opening formed in the front wall 704, and its other end, with the upper end portion of the developer holding chamber 728 of the developing device 712 through the other opening formed in the front wall 704. One end portion **774*a* of the helical member 772 provided in the hollow cylindrical member 770 extends further to the toner recovery chamber 716 from one end of the hollow cylindrical member 770, and its other end portion 774*b*, further to a space 776 defined by a nearly U-shaped part 722*a* in the wall 722 of the developing device 712 from the other end of the hollow cylindrical member 770*a*. Accordingly, when the helical member 772 is rotated in a predetermined direction, the toner in the toner recovery chamber 716 is fed to the space 776 in the developer holding chamber 728 through the hollow cylindrical member 770, then advances beyond the upper edge of the part 772*a* of the wall 772, and fed to the bottom of the developer holding chamber 728**.

Otherwise, the process unit 702 has substantially the same structure as the process unit shown in the second embodiment. The process unit 702 can be mounted detachably on the supporting structure (the upper supporting frame 6 in the first embodiment of the copying machine in place of the process unit 16 in the first embodiment.

At the time of starting an electrostatic copying machine provided with the process unit 702, a starting developer loaded in the developer holding chamber 728 of the developing device 712 in advance during machine production is fed to the developing chamber 726, and the toner cartridge 756 is detachably loaded into the cartridge receiving space 750 of the cleaning device 714. The starting developer may be supplied, for example, by depressing a starting developer supply switch (not shown). In the illustrated embodiment, the feed roller 732 is rotated for a predetermined period of time on the basis of a supply signal produced by depressing the starting developer supply switch. When the feed roller 732 is so rotated, the starting developer loaded in the developer holding chamber 728 is fed to the developing chamber 726 through the discharge opening 730. Loading ot the cartridge 756 can be achieved, for example, as follows. In the illustrated embodiment, first the cartridge 756 is inserted in the direction shown by an arrow 780 through the opening 766 formed in the front wall 704 of the unit frame 708 while its part to which the seal member 764 is bonded is placed upward. During this insertion, the seal member sealing the discharge opening 762 of the toner cartridge 756 is peeled. When the cartridge 756 is inserted into the cartridge receiving space 750, the seal member 764 separates from the peripheral side surface 758 of the cartridge, and the discharge opening 762 of toner cartridge 756 is opened. Thereafter, the toner cartridge 756 is rotated through about 180 degrees in the direction shown by an arrow 782 (FIG. 20). As a result, the discharge opening 762 is located below, and the fresh toner in the toner cartridge 756 is fed to the bottom of the toner recovery chamber 716 through the discharge opening 762 and the opening 752 defined by the wall 742. Consequently, the copying machine is ready for copying.

When the residual toner is removed from the surface of the rotating drum 710 by the action of the elastic blade 748 as the copying operation is performed, the toner is recovered in the bottom of the recovery chamber 716. Since the fresh toner fed from the toner cartridge 756 is present in the bottom of the toner recovery chamber 716, the recovered toner is mixed with the fresh toner. Mixing of the recovered toner with the fresh toner can be achieved by rotating the helical member 772 for toner transfer. If desired, stirring means may be separately provided for exclusively carrying out this mixing.

The toner present at the bottom of the toner recovery chamber 716 (the mixed toner containing the new toner and the recovered toner) is fed to the space 776 in the developer holding chamber 728 via the hollow cylindrical member 770 by rotating the helical member 772. To perform the mixing of the toners in the toner recovery chamber 716 and the transfer of the mixed toner to the developing device 712, it is preferred to position the opening 762 formed in the wall 742 such that it deviates by 5 to 40 degrees to that side which is opposite to the side of the rotating drum 710 with respect to the rotating central axis of one end portion 774*a* of the helical member 772. The toner fed to the space 776 as described above advances beyond the upper edge of the part 722*a* of the wall 722 and is fed to the bottom of the developer holding chamber 728. Substantially all the starting developer loaded in the developer holding chamber 728 is fed to the developing chamber 726 at the time of use. Accordingly, the toner from the toner recovery chamber 716 is fed to the neighborhood of the discharge opening 730 of the developer holding chamber 728 which is substantially empty. The toner so fed is fed to the developing chamber 726 through the discharge opening 730 by the rotation of the feed roller 732. The toner from the toner recovery chamber 716 can be fed substantially uniformly along the entire width of the developer holding chamber 728 by, for example, constructing the part 722*a* of the wall 722 as shown in FIGS. 9 and 10.

In the electrostatic copying machine provided with the process unit 702 of the described structure, the process unit 702, and therefore the entire copying machine, can be reduced in size by effectively utilizing the toner recovery chamber 716 of the cleaning device 714 and the developer holding chamber 728 of the developing device 712 which becomes a substantially wasteful space after feeding the starting developer. Furthermore, since this machine is of such a structure that the toner cartridge 756 is loaded into the toner recovery chamber 716, the toner supplying operation is very easy and simple.

Modified Embodiments

The present invention can be applied to such a type of image forming machine which is provided with an ordinary supporting structure (the type shown in FIG. 12) as it can be applied to the type of image forming machine which is provided with a supporting structure consisting of a lower supporting frame and an upper supporting frame mounted on the lower supporting frame for free pivoting between an open position and a closed position (the type shown in FIGS. 1 to 4).

The present invention can be applied to an image forming machine provided with a developing device of the type which uses a one-component developer composed only of toner, as it can, to an image forming machine provided with a developing device of the type which uses a two-component developer composed of carrier and toner.

What is claimed is:

1. An image forming machine comprising:

an image bearing member having a photosensitive material thereon;

a developing device for developing a latent electrostatic image formed on a surface of the photosensitive material, said developing device including a developing chamber, applicator means disposed in said developing chamber for applying toner to the latent electrostatic image, and a toner holding chamber communicating with said developing chamber through a toner discharge opening;

a cleaning device for removing residual toner remaining on the surface of the photosensitive material, said cleaning device including toner removing means for acting on the surface of the photosensitive material and removing the residual toner, and a toner recovery chamber for recovering the residual toner removed by said toner removing means; and toner feed means for conducting the toner in said cleaning device to said developing device, said toner feed means including a hollow cylindrical member connecting said cleaning device to said developing device and permitting communication between said toner recovery chamber and said toner holding chamber, and toner transfer means disposed within said hollow cylindrical member for transferring the toner in said toner recovery chamber to said toner holding chamber through said hollow cylindrical member, said hollow cylindrical member having a transparent or semitransparent portion.

2. The image forming machine of claim 1 further comprising:

a unit frame, said image bearing member, said developing device and said cleaning device mounted on said unit frame, and said hollow cylindrical member provided in said unit frame; and a supporting structure, said unit frame detachably mounted on said supporting structure, said hollow cylindrical member acting as a gripping portion when mounting said unit frame on and detaching said unit frame from said supporting structure.

3. The image forming machine of claim 2 wherein said supporting structure comprises a lower supporting frame, and an upper supporting frame mounted on the lower supporting frame for pivoting between an open position and a closed position; said unit frame is mounted detachably on said upper supporting frame; and said hollow cylindrical member is positioned substantially horizontally when said upper supporting frame is at the open position.

4. The image forming machine of claim 3 further comprising first supporting portions provided on said upper supporting frame; and second supporting portions provided on said unit frame and detachably mounted on said first supporting portions; said first supporting portions supporting said second supporting portions in a substantially perpendicular direction when said supporting frame is at the open position.

5. The image forming machine of claim 3 further comprising an openable and closable front cover member disposed ahead of said upper supporting frame; and a window portion provided in said front cover member, said window portion permitting viewing of the transparent or semi-transparent portion of the hollow cylindrical member when the front cover member is in a closed position.

6. An image forming machine comprising a supporting structure and a process unit adapted to be detachably mounted on said supporting structure, said process unit comprising:

an image bearing member having a photosensitive material thereon;

a developing device for developing a latent electrostatic image formed on a surface of the photosensitive material, said developing device including a developing chamber, applicator means disposed in said developing chamber for applying toner to the latent electrostatic image, and a toner holding chamber communicating with said developing chamber through a toner discharge opening;

a cleaning device for removing residual toner remaining on the surface of the photosensitive material, said cleaning device including toner removing means for acting on the surface of the photosensitive material and removing the residual toner, and a toner recovery chamber for recovering the toner removed by said toner removing means;

a unit frame, said image bearing member, said developing device and said cleaning device mounted on said unit frame; and toner feed means for conducting the toner in said cleaning device to said developing device, said toner feed means including a hollow cylindrical member connecting said cleaning device to said developing device and permitting communication between said toner recovery chamber and said toner holding chamber, and toner transfer means disposed within said hollow cylindrical member for transferring the toner in said toner recovery chamber to said toner holding chamber through said hollow cylindrical member, said hollow cylindrical member acting as a gripping portion when mounting said unit frame on and detaching said unit frame from said supporting structure.

7. The image forming machine of claim 6 wherein said supporting structure comprises a lower supporting frame and an upper supporting frame mounted on the lower supporting frame for pivoting between an open position and a closed position; said unit frame is detachably mounted on said upper supporting frame; and said hollow cylindrical member is positioned substantially horizontally when said upper supporting frame is at the open position.

8. The image forming machine of claim 7 further comprising first supporting portions on said upper supporting frame; and second supporting portions provided on said unit frame and detachably mounted on said first supporting portions; said first supporting portions supporting said second supporting portions in a substantially perpendicular direction when said supporting frame is at the open position.

9. An image forming machine comprising a supporting structure and a process unit adapted to be detachably mounted on said supporting structure, said process unit comprising:

an image bearing member having a photosensitive material thereon;

a developing device for developing a latent electrostatic image formed on a surface of the photosensitive material;

a cleaning device for removing toner remaining on the surface of the photosensitive material;

a unit frame, said image bearing member, said developing device, and said cleaning device mounted on said unit frame; and toner feed means for feeding the toner recovered in said toner recovery chamber to said developing device and for re-feeding the toner recovered in said toner recovery chamber to the vicinity of the toner discharge opening of said toner holding chamber, said developing device including a developing chamber, applicator means disposed in said developing chamber for applying toner to the latent electrostatic image, and a toner holding chamber for holding unused toner and communicating with said developing chamber through a toner discharge opening;

said cleaning device including toner removing means for acting on the surface of the photosensitive material and removing the residual toner and a toner recovering chamber for recovering the toner removed by said toner removing means;

whereby the toner from said toner recovery chamber is mixed with toner in said toner holding chamber near the toner discharge opening and the mixed toner is fed to said developing chamber through the toner discharge opening.

10. The image forming machine of claim 9 wherein the toner holding chamber includes a mixing chamber in a lower portion thereof and a first holding chamber and a second holding chamber above the mixing chamber; the first holding chamber holds fresh unused toner; the second holding chamber holds the toner fed from the toner recovery chamber; and the toner fed from the first holding chamber and the toner fed from the second holding chamber are mixed in the mixing chamber, and the mixed toner is fed to the developing chamber through the toner discharge opening.

11. The image forming machine of claim 10 wherein the first and second holding chambers are juxtaposed, and the toner from the first holding chamber and the toner from the second holding chamber are fed to the mixing chamber substantially uniformly in the widthwise direction of the mixing chamber.

12. The image forming machine of claim 11 wherein the second holding chamber is defined by a nearly U-shaped wall portion; the toner feed means includes a helical member extending from the toner recovery chamber into the second holding chamber; and the toner fed to the second holding chamber advances beyond the upper edge of one side end of said wall portion and is fed to the mixing chamber by the action of the helical member.

13. The image forming machine of claim 12 wherein said upper edge of one side end of the wall portion defining the second holding chamber has a progressively decreasing height from one end toward the other end of the mixing chamber in its widthwise direction.

14. The image forming machine of claim 12 wherein the bottom of the wall portion defining the second holding chamber is progressively elevated from one end toward the other end of the mixing chamber in the widthwise direction.

15. The image forming machine of claim 9 further comprising a hollow guide member disposed near the toner discharge opening of the toner holding chamber; the toner feed means including a helical member extending from the inside of the toner recovery chamber into the hollow guide member; whereby the toner recovered in the toner recovery chamber is fed into the hollow guide member and fed to the vicinity of the toner discharge opening through an opening formed in the hollow guide member by the action of the helical member.

16. The image forming machine of claim 15 further comprising mixing chamber in the lower portion of the toner holding chamber; a first holding chamber above the mixing chamber; a second holding chamber in the upper portion of the mixing chamber by the hollow guide member; whereby fresh unused toner is held in the first holding chamber the toner fed from the first holding chamber and the toner fed from the second holding chamber are mixed in the mixing chamber and the mixed toner is fed to the developing chamber through the toner discharge opening.

17. The image forming machine of claim 16 wherein the toner from the first holding chamber and the toner from the second holding chamber are fed to the mixing chamber substantially uniformly in the widthwise direction of the mixing chamber.

18. The image forming machine of claim 17 wherein a plurality of openings spaced from each other in the widthwise direction of the mixing chamber are formed in the lower portion of the hollow guide member; and the plurality of openings are progressively larger toward one end in the widthwise direction of the mixing chamber and progressively smaller toward the other end in the widthwise direction of the mixing chamber.

19. An image forming machine comprising:

an image bearing member having a photosensitive material thereon;

a developing device for developing a latent electrostatic image formed on a surface of the photosensitive material, said developing device having a developing chamber and applicator means disposed in said developing chamber for applying toner to the latent electrostatic image;

a cleaning device for removing residual toner remaining on the surface of the photosensitive material, said cleaning device having toner removing means for acting on the surface of the photosensitive material and removing the residual toner and a toner recovery chamber for recovering the toner removed said toner removing means, wherein unused toner is sealed in said toner recovery chamber; and toner feed means for feeding the toner in said toner recovery chamber to said developing chamber.

20. The image forming machine of claim 19 wherein the image bearing member, the developing device and the cleaning device are mounted on a unit frame detachably mounted on a supporting structure to constitute a process unit.

21. The image forming machine of claim 19 further comprising sealing means openably disposed at a recovery opening of the toner recovery chamber in the cleaning device.

22. The image forming machine of claim 21 wherein the sealing means comprises a seal member detachably bonded to the recovery opening of the toner recovery chamber.

23. The image forming machine of claim 19 further comprising agitating means, disposed in the toner recovery chamber of the cleaning device, for mixing fresh unused toner with the toner removed from the surface of the photosensitive material and recovered in the toner recovery chamber.

24. The image forming machine of claim 19 wherein the toner feed means comprises a hollow cylindrical member connecting the toner recovery chamber of the cleaning device to the developing chamber of the developing device, and toner transferring means disposed rotatably in the hollow cylindrical member, for transferring the toner by rotation in a predetermined direction.

25. The image forming machine of claim 24 wherein the toner transfer means is comprised of a helical member one end portion of which extends substantially from one end to the other end of the toner recovery chamber of the cleaning device at the bottom of the toner recovery chamber; and hollow guide member is disposed in the upper portion of the developing chamber of the developing device along the entire width of the developing chamber; a toner discharge opening for discharging toner is formed in the lower portion of the hollow guide member; and the other portion of the helical member extends through the hollow guide member substantially from one end to the other end of the hollow guide member.

26. The image forming machine of claim 25 wherein the toner discharge opening formed in the hollow guide member extends substantially from one end to the other end of the hollow guide member, and the opening width of the toner discharge opening progressively increases in the toner transferring direction.

27. The image forming machine of claim 25 further comprising discharge opening sealing means disposed openably at the toner discharge opening of the hollow guide member.

28. The image forming machine of claim 27 wherein the discharge opening sealing means is comprised of a seal member detachably bonded to the toner discharge opening of the hollow guide member.

29. An image forming machine comprising:

an image bearing member having a photosensitive material thereon;

a developing device for developing a latent electrostatic image formed on a surface of the photosensitive material, said developing device having a developing chamber for holding a developer and applicator means disposed in said developing chamber for applying toner to the latent electrostatic image;

a cleaning device for removing residual toner remaining on the surface of the photosensitive material, said cleaning device having toner removing means for acting on the surface of the photosensitive material and removing the residual toner, and a toner recovery chamber for recovering the toner removed by said toner removing means;

a toner cartridge containing unused toner for supplying the unused toner to said developing chamber, the toner cartridge adapted to be loaded into said toner recovery chamber; and toner feed means for feeding the toner present in said toner recovery chamber to said developing device.

30. The image forming machine of claim 29 wherein the developing device is provided with a developer holding chamber which communicates with the developing chamber through a discharge opening and receives a starting developer, and the toner feed means feeds the toner present in the toner recovery chamber to the developer holding chamber.

31. The image forming machine of claim 30 wherein the feed means comprises a hollow cylindrical member connecting the toner recovery chamber of the cleaning device to the developer holding chamber of the developing device and toner transfer means disposed in the hollow cylindrical chamber, and the toner transfer means mixes the unused toner present in the toner recovery chamber with the toner recovered in the recovery chamber from the surface of the photosensitive material by the action of the toner removing means, and feeds the mixed toner to the developer holding chamber.

32. The image forming machine of claim 30 wherein the toner from the toner recovery chamber is fed to the developer holding chamber substantially uniformly in the widthwise direction of the developer holding chamber.

* * * * *